US005419347A

United States Patent [19]

Carruth

[11] Patent Number: 5,419,347

[45] Date of Patent: May 30, 1995

[54] AUTOMATED FLUSHING MODULE

[75] Inventor: W. Layne Carruth, Cordova, Tenn.

[73] Assignee: SSI Medical Services, Inc., Charleston, S.C.

[21] Appl. No.: 144,747

[22] Filed: Oct. 27, 1993

Related U.S. Application Data

[63] Continuation-in-part of Ser. No. 976,354, Nov. 16, 1992, abandoned.

[51] Int. Cl.[6] ..... B08B 3/02; B08B 9/00

[52] U.S. Cl. ..... 134/57 R; 134/95.1; 134/113; 134/169 R; 134/171; 134/200

[58] Field of Search ..... 134/57 R, 95.1, 113, 134/166 R, 169 R, 171, 200

[56] References Cited

U.S. PATENT DOCUMENTS

| | | | |
|---|---|---|---|
| 3,385,265 | 5/1968 | Schrader . | |
| 3,739,791 | 6/1973 | Fry et al. | 134/169 R X |
| 3,920,030 | 11/1975 | Mason | 134/171 X |
| 3,922,730 | 12/1975 | Kemper . | |
| 4,015,614 | 4/1977 | Jonsson et al. | 134/171 X |
| 4,059,123 | 11/1977 | Bartos et al. . | |
| 4,130,123 | 12/1978 | Wines, Jr. et al. . | |
| 4,142,539 | 3/1979 | Shih et al. | 134/113 |
| 4,281,674 | 8/1981 | Tanaka et al. | 134/171 X |
| 4,668,227 | 5/1987 | Kay | 134/95.1 X |
| 4,791,890 | 12/1988 | Miles et al. . | |
| 4,838,288 | 6/1989 | Wright et al. | 134/113 X |
| 4,858,632 | 8/1989 | Jay, Jr. et al. . | |
| 5,024,744 | 6/1991 | Okabayashi | 134/113 X |
| 5,095,925 | 3/1992 | Elledge et al. | 134/200 X |
| 5,133,374 | 7/1992 | Druding et al. | 134/169 R X |
| 5,165,141 | 11/1992 | Soltani . | |
| 5,184,634 | 2/1993 | Kitajima | 134/166 R X |
| 5,310,524 | 5/1994 | Campbell et al. | 134/166 R X |

FOREIGN PATENT DOCUMENTS

| | | |
|---|---|---|
| 2524912 | 12/1976 | Germany . |
| WO9309749 | 5/1993 | WIPO . |

*Primary Examiner*—Philip R. Coe
*Attorney, Agent, or Firm*—Dority & Manning

[57] ABSTRACT

The system of the present invention is an all-automated and all hands-free, flushing module with the capability of performing an internal cleansing of internally soiled components of a patient support apparatus configured for one or more of the care, maintenance or treatment of a patient. The system is configured with at least one bay to receive a patient support apparatus to be cleaned. The system is designed so that additional bays can be used to clean two or three patient support apparatus at one time. The system includes hoses supplying liquid into the bed's internal surfaces that come into contact with substances associated with one or more of the care, maintenance and/or treatment of a patient on the patient support apparatus. The system automatically goes through a flush cycle, a wash cycle and a rinse cycle. The system has extra compartments for jug washing. The system takes predetermined amounts of bactericides or all of the cleansing agents, mixes them with tap water, uses the mixed liquids for washing or rinsing, and then the liquids used for washing or rinsing are disposed into the sewer system.

26 Claims, 10 Drawing Sheets

AUTOMATED FLUSHING MODULE

BACKGROUND OF THE INVENTION

This is a continuation-in-part application to application Ser. No. 07/976,354, filed on Nov. 16, 1992, and now abandoned, which is hereby incorporated herein by this reference.

The present invention relates to an automated cleansing apparatus and method and more particularly to an automated apparatus and method for cleaning and disinfecting the internal surfaces of various conduits and chambers of devices that are dedicated to the support of patients in environments for one or more of the care, maintenance and treatment of the patient. Typically, such devices employ various liquid impermeable conduits, chambers and the like that have internal surfaces which become exposed to substances associated with the care, maintenance and treatment of the patient as the device is in service. For example, in an incontinence management system, the internal surfaces of these conduits, chambers and the like become exposed to urine and feces. Since the internal surfaces are not readily accessible to the attending personnel, such persons typically cannot clean them manually without completely disassembling various portions of the device and removing the components. However, the internal surfaces of these conduits, chambers and the like are desirably, and in many cases required to be, cleaned and disinfected before using the device with a new patient. Moreover, such cleaning and disinfecting desirably, if not mandatorily, is performed on a periodical basis, notwithstanding whether the device is being used by the same patient. Furthermore, the cleaning and disinfecting of such surfaces are not tasks that attending personnel, such as hospital staff, anticipate with positive feelings.

OBJECTS AND SUMMARY OF THE INVENTION

It is a principal object of the present invention to provide an automatic apparatus and method of cleansing a device for supporting a patient during the care, maintenance and/or treatment of the patient, wherein internal components of such patient support device become soiled with one or more substances associated with the care, maintenance and/or treatment of the patient.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the apparatus of the present invention is a substantially automated and hands-free, flushing module with the capability of performing an internal cleansing of internally soiled components of patient support devices such as the CLENSICAIR ® bed. The flushing module of the present invention is designed to be used in an environment that is appropriately wired with 220 volt and 110 volt electrical lines. The environment should provide the flushing module with plumbing access to the sewer system and to fresh water lines. The environment should have adequate space to accommodate the flushing module and at least one bed to be cleaned. However, the flushing module is designed to be used in an environment where more than one flushing module is used to clean two or three beds at one time. The bed's rinse jug and waste holding jug are disconnected from the foot of the bed. The flushing module has hoses that are connected to the bed to supply liquid from the flushing module into the bed's internal chambers, conduits and the like. For example, the hoses of the flushing module are connected into the connectors for the rinse and holding jugs of the CLENSICAIR ® bed. The number of hoses employed by the flushing module to supply liquid to the bed and remove liquid from the bed can be changed to suit the requirements of the particular bed being cleaned. Similarly, the connectors on the ends of the hoses can be changed to mate with the particular bed being cleaned.

Once connected to the bed, the flushing module cleanses the internals of the bed with a mechanism that is hands-free of the technicians. For example, the flushing module takes predetermined amounts of bactericides and/or cleansing agents, mixes them with warm water, uses them for washing and/or rinsing, and then the liquids used for washing and/or rinsing are disposed into the sewer system. The flushing module has a reservoir, tanks, conduits, manifolds, hoses, fittings, nozzles, wands, valves, pumps, liquid flow rate sensors, and liquid level sensors. The flushing module is run by a preprogrammed controller that automatically operates the individual and collective components of the module. For example, the controller operates a chemical metering pump and various valves to prepare controlled volumes of liquids to be used in the module's cycles of operation. The controller governs the operation of a recirculation pump during the cycles. The controller monitors various flow rate sensors to assure operation at turbulent flow rates. The controller monitors various liquid level sensors to assure normal operation of the module. The module's controller can be preprogrammed to operate various functions of the bed, either directly or through the bed's own controller. The flushing module has extra compartments, wands and nozzles for washing the bed's removable waste receptacles.

The flushing module is designed to clean and disinfect the internally soiled components of the patient support device. The basic steps of the operating procedure include a flushing cycle, a cleaning and disinfecting cycle, and a final rinsing cycle. During the flushing cycle, the bed's hoses, valves, tanks and fittings are subjected to a controlled volume of tap water, to wash out sediments and easily removed deposits of waste material. During the cleaning and disinfecting cycle, these same bed components are subjected to a recirculating solution of detergent/disinfectant (such as UNICIDE TM) in warm water, for a controlled period of time. The module is designed so that the liquids can be sucked through the internally soiled components of the bed. The module is designed to monitor and maintain turbulent flow in each of the lines, in order to maximize the cleaning effectiveness of the process. The module is designed so that an additional pressure head can be used to propel the flow of the liquids through the bed. The module also can be controlled to perform a soaking cycle and a selective sequencing of flow through different liquid pathways of the bed. During the rinsing cycle, the bed's same components are subjected to a measured volume of tap water to remove any detergent residues. The module can include a drain surge tank with sufficient capacity to store soiled liquids temporarily in the event that the sewer line becomes blocked during operation of the module. While the module performs the various cycles, it monitors for normal liquid levels in the tanks and normal flow rates in the hoses and pipes.

The accompanying drawings, which are incorporated in and constitute a part of this specification, illustrate at least one preferred embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which being illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
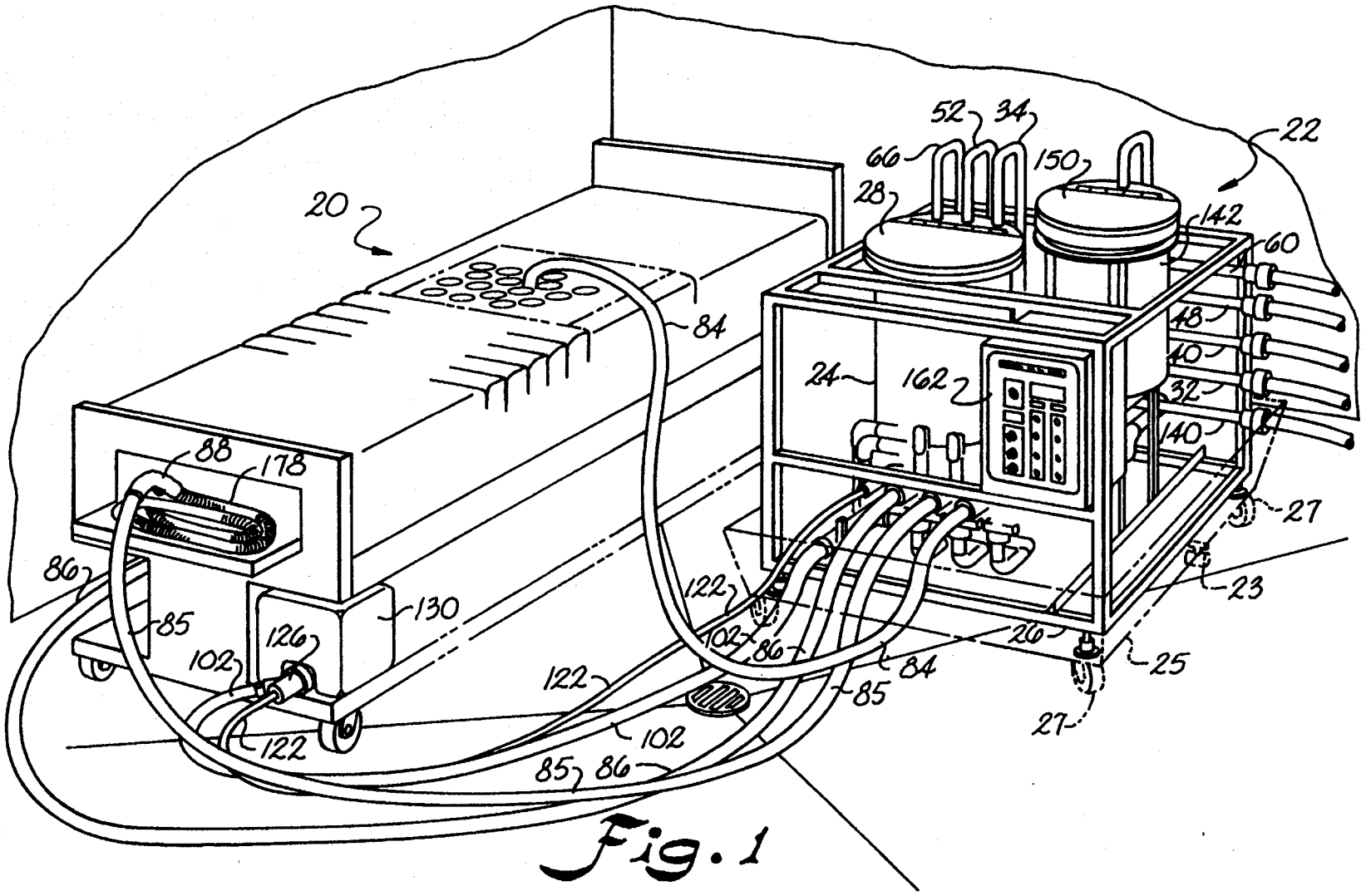
FIG. 1 is an elevated perspective view of a preferred embodiment of the present invention.

The present invention is designed to cleanse and disinfect the internal surfaces of various conduits and chambers of devices that are dedicated to the support of patients in environments relating to the care, maintenance and/or treatment of the patient. As these patient support devices are being used, they have hoses, conduits, containers, chambers, fittings and other liquid handling components that have internal surfaces which become soiled and/or contaminated by substances associated with one or more of the care, maintenance and/or treatment of the patient. One such patient support device is an Incontinence Management System (IMS) such as the CLENSICAIR® bed disclosed in U.S. patent application Ser. No. 07/792,216, filed on Nov. 13, 1991, and now U.S. Pat. No. 5,269,030, and U.S. patent application Ser. No. 08/074,860, filed on Jun. 11, 1993. The disclosures of each of these applications are hereby incorporated herein by this reference. An embodiment of the CLENSICAIR® bed is shown in FIG. 1 and is indicated generally by the numeral 20. The CLENSICAIR® bed is used for purposes of illustrating the present invention, which automatically steps through a controlled sequence of cleaning and disinfecting operations designed to ensure that each soiled internal component is adequately and uniformly cleaned and disinfected without requiring disassembly of the patient support device. However, other types of patient support devices with soiled internal components also can be cleaned by the present invention.

Figure 2:
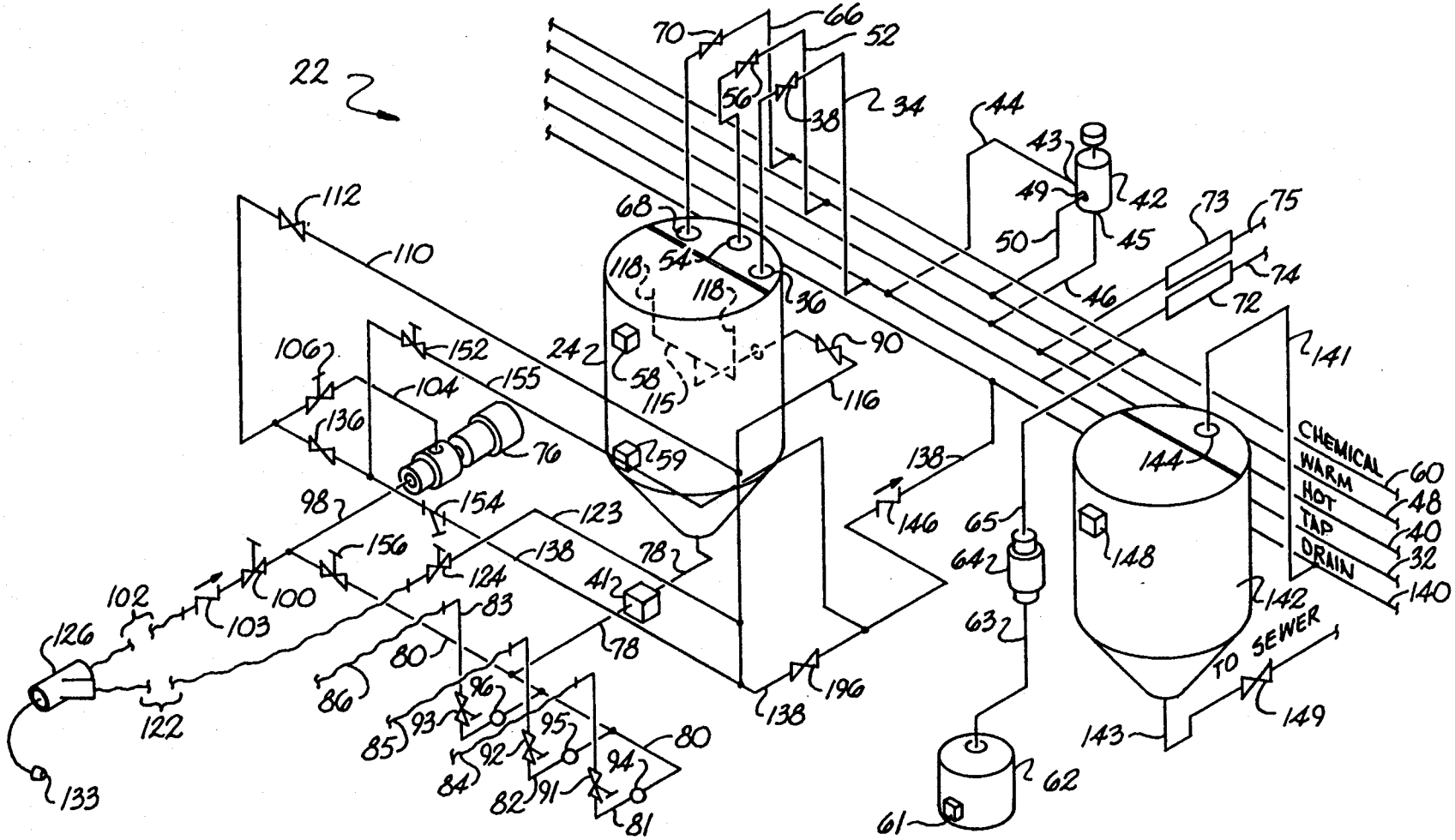
FIG. 2 is a schematic diagram of liquid-carrying components according to the embodiment of FIG. 1.
Figure 2A:
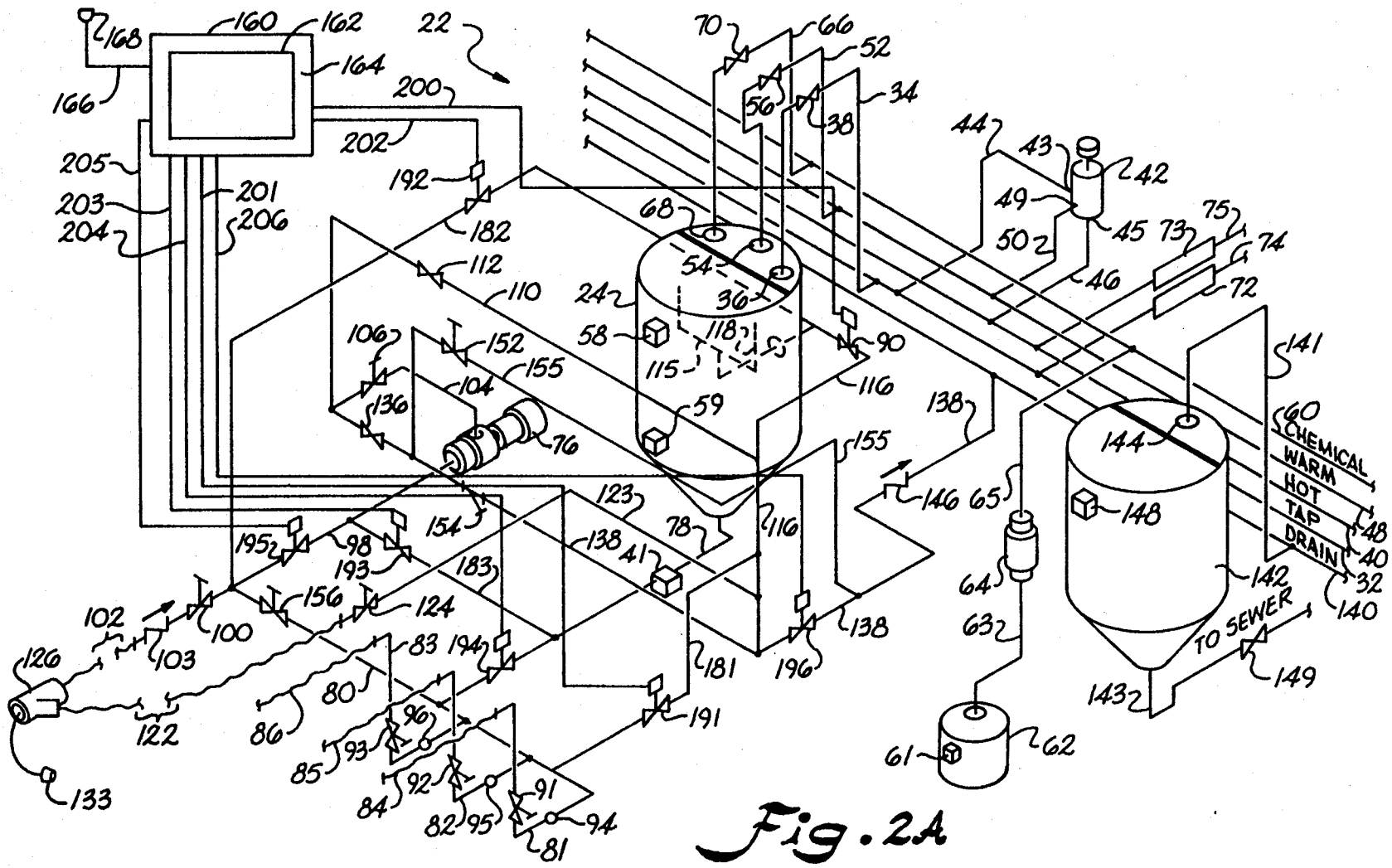
FIG. 2A is a schematic diagram of selected liquid-carrying components and electrically connected components of an alternative embodiment of the present invention.
Figure 3:
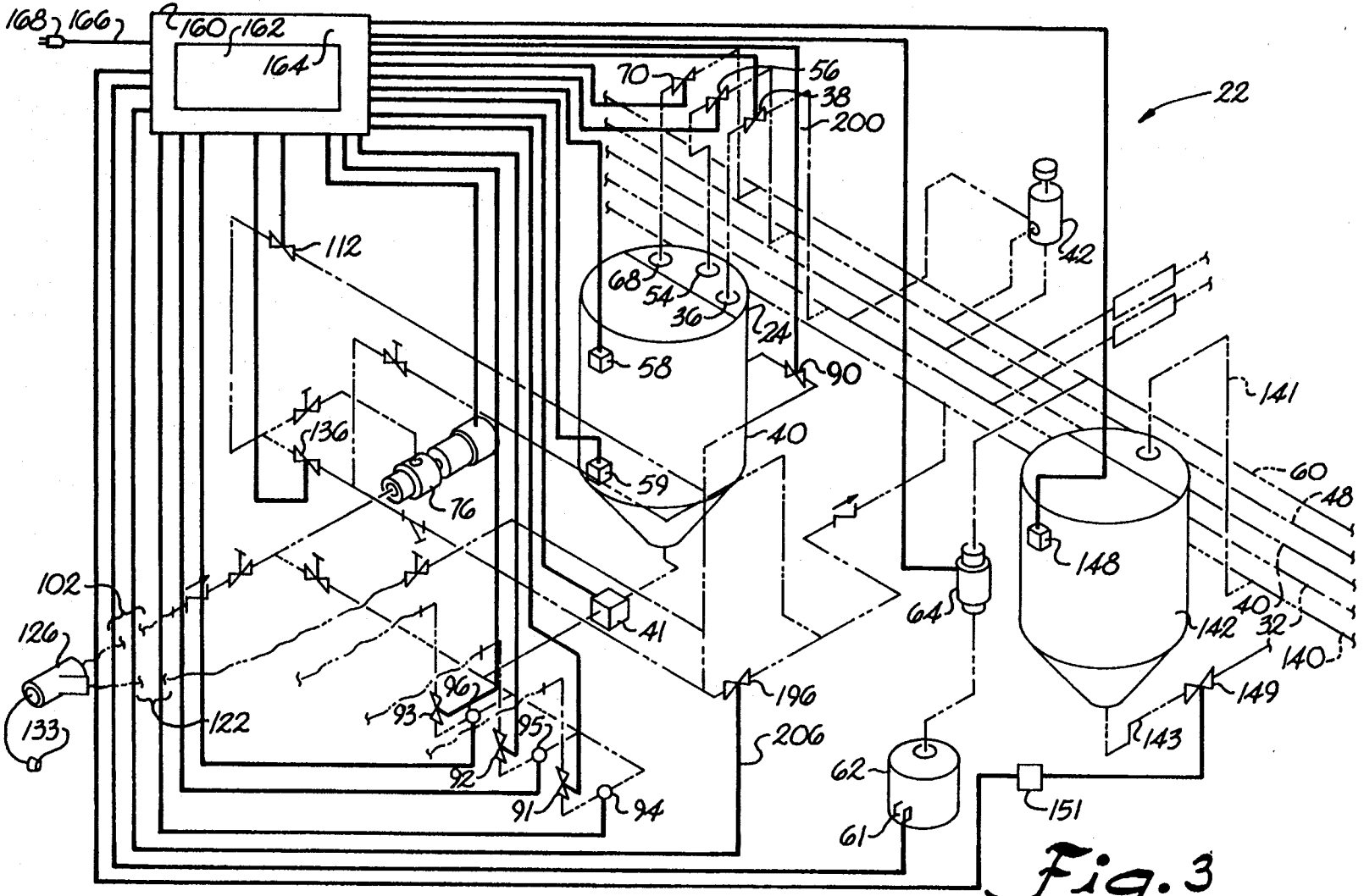
FIG. 3 is a schematic diagram of some components interacting with the controller according to the embodiment of FIG. 1 with solid lines in the foreground depicting some of the electrical connections, and the liquid-carrying conduits depicted in dashed lines in the background.

A preferred embodiment of the present invention's apparatus, which also is known as a flushing module, is shown in FIGS. 1–3 and is represented generally by the numeral 22. In FIG. 2, the solid lines schematically represent conduits, pipes and the like which carry liquids. In FIG. 3, the dashed lines schematically represent conduits, pipes and the like which carry liquids, and the heavy solid lines schematically represent cables, wires and the like which carry electrical signals. In FIG. 2A, some of the solid lines schematically represent conduits, pipes and the like which carry liquids, and some of the solid lines schematically represent cables, wires and the like which carry electrical signals.

In accordance with the present invention, a means is provided for preparing liquid to be supplied to at least one of the internal surfaces of the patient support device wherein such internal surface has been exposed to soiling with one or more substances associated with the care, maintenance, and/or treatment of a patient. As embodied herein and shown in FIGS. 1–6, the liquid preparing means can include a recirculation tank 24, which desirably is formed as a 30 gallon capacity cone bottom polyethylene tank having an 18-inch diameter and a thirty-inch straight side. As shown in FIG. 1, recirculation tank 24 is disposed within a support frame 26 formed of a plurality of stainless steel rectilinear members joined together at right angles by conventional fastening means such as screws and bolts as well as being welded where permanent attachment is desired.

A means for mobilizing the module's support frame can be provided. As schematically shown in the FIG. 1 for example, in a mobile embodiment of flushing module 22, support frame 26 can be carried by heavy duty casters 27 (shown in phantom) such as disclosed in U.S. Pat. No. 5,165,141, which is hereby incorporated herein by this reference.

Figure 4:
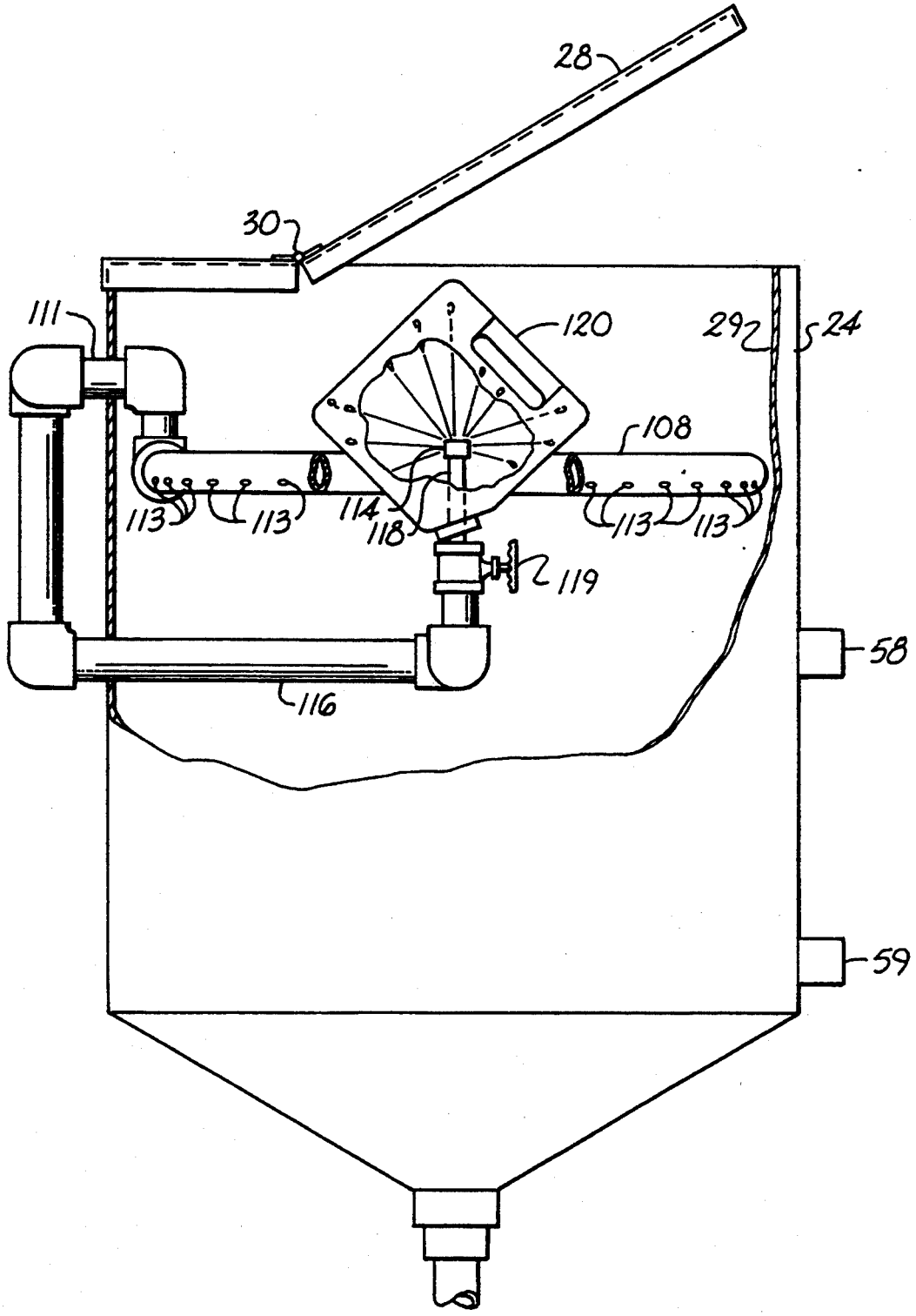
FIG. 4 is a side plan view with portions cut away of preferred embodiments of components of the present invention.
Figure 5:
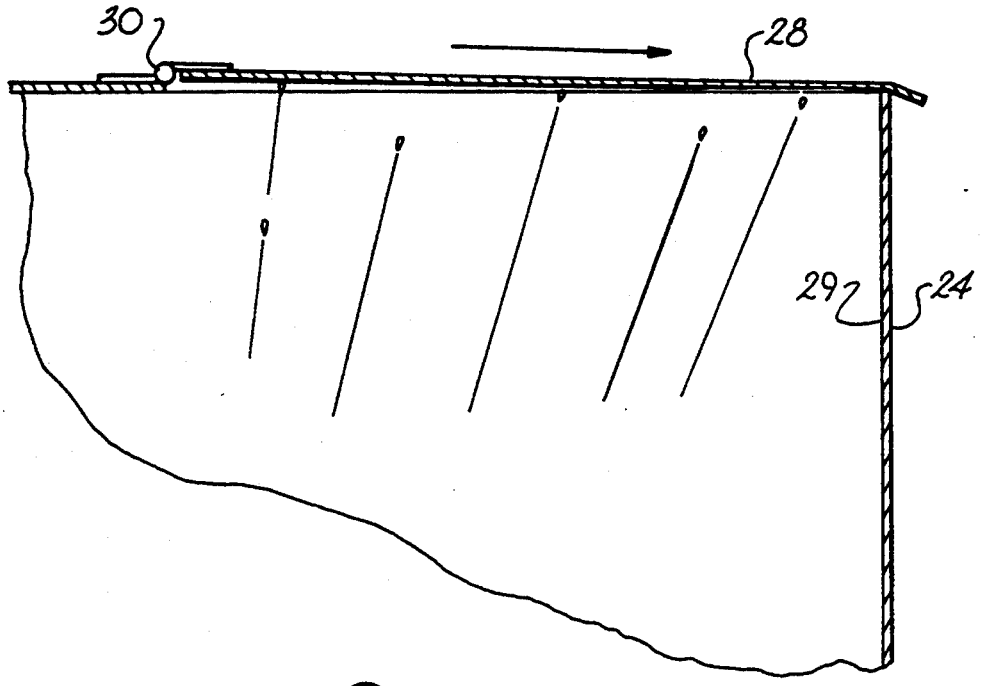
FIG. 5 is a cross-sectional view of certain of the components shown in FIG. 4.

As shown in FIGS. 4 and 5, recirculation tank 24 desirably is provided with a lid 28 hingedly attached to cover at least a portion of the top of recirculation tank 24. The lid prevents splashing and keeps aerosol mists inside the tank so that they do not contaminate the area surrounding the flushing module. In this way, lid 28 functions as a means for safeguarding personnel against routine contact with substances associated with the care, maintenance, and treatment of patients in the devices being cleaned. As shown in FIG. 5, the lid desirably is configured and disposed at a slight angle below the horizontal when positioned to cover the tank. In this way, liquid sprayed inside the tank drains toward the straight sidewall 29 of the tank and accumulates there until sufficient accumulation occurs that the weight of the liquid separates the liquid from the surface of the lid and returns the liquid to the liquid level inside the tank. When the tank lid is lifted as shown in FIG. 4, the same accumulating liquid drains toward the hinge 30 of the lid. In both cases, liquid impinging on the underside surface of lid 28 is prevented from accumulating evenly on the underside surface and is more likely to coalesce and drop into the tank.

Figure 11:
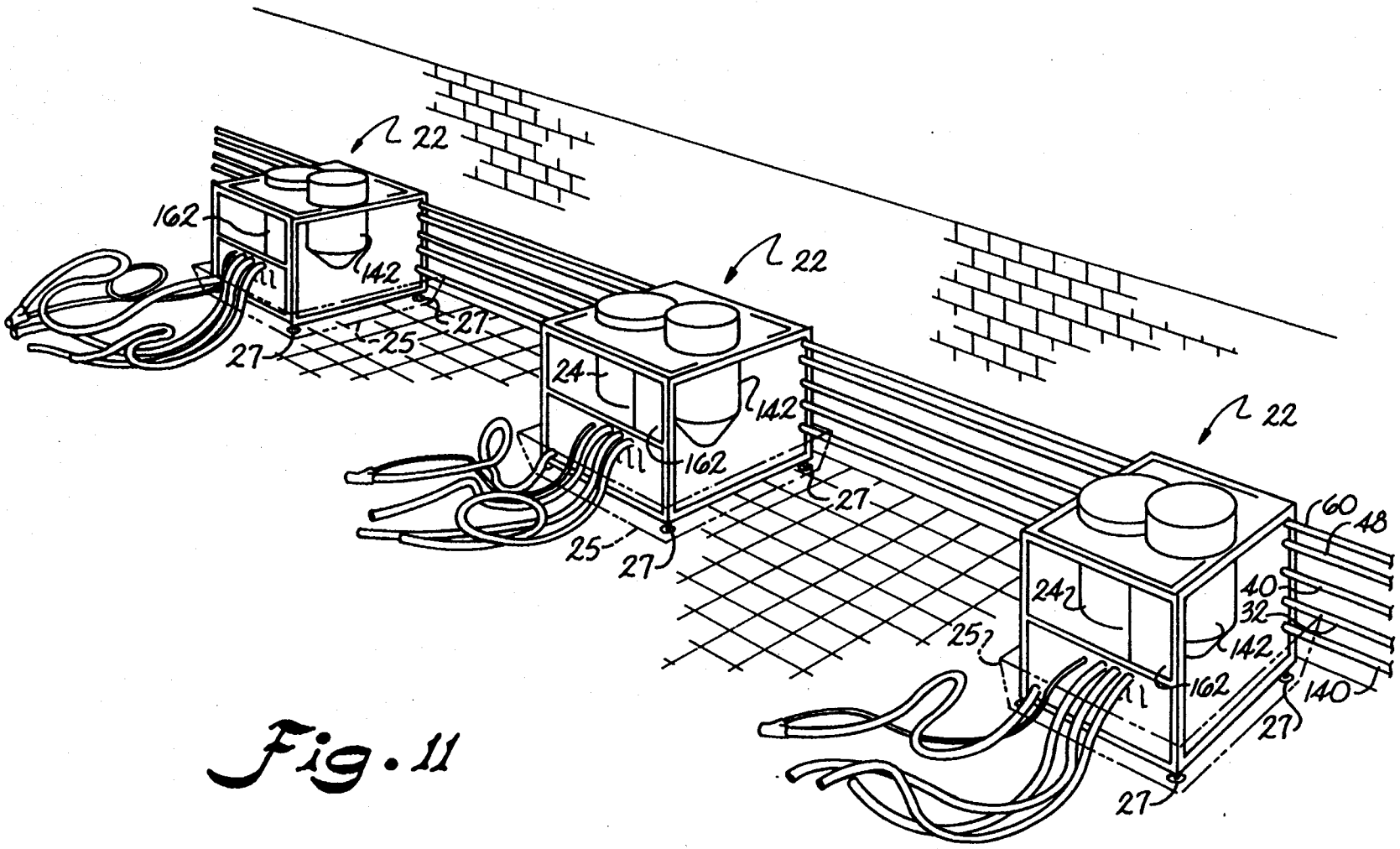
FIG. 11 is an elevated perspective view of an alternative preferred embodiment of the present invention.

As shown in FIGS. 1, 2 and 11, the liquid preparing means can further desirably include a tap water conduit 32 that is configured to be selectively connectable (by a valve not shown) in communication with a supply of tap water provided by the facility which houses each flushing module 22. As shown in FIG. 2, tap water conduit 32 is connected to one end of a tap water branch pipe 34. The other end of the tap water branch pipe is connected to a tap water inlet port 36 formed in the top of recirculation tank 24. As shown in FIGS. 1 and 2, tap water branch pipe 34 is carried by the support frame that defines the flushing module. As schematically shown in FIGS. 2 and 3, a tap water solenoid valve 38 is disposed in communication with tap water conduit 32 and tap water inlet port 36 of recirculation tank 24 so as to be operable to regulate the amount of tap water permitted to flow from tap water conduit 32 to tap water inlet port 36 of recirculation tank 24. Tap water valve 38 enables tap water inlet port 36 to be selectively connectable in communication with tap water conduit 32.

As shown in FIGS. 1, 2 and 11, the liquid preparing means can further desirably include a hot water conduit 40 that is configured to be selectively connectable (by a valve not shown) in communication with a supply of hot water provided by the facility which houses each flushing module 22.

In still further accordance with the present invention, the liquid preparing means can include a means for regulating the temperature of the liquid that is prepared to be supplied to the internal soiled surfaces of the patient support device. As embodied herein and shown in FIG. 2 for example, the temperature regulating means desirably includes a temperature mixing valve 42 having a first inlet 43 connected in communication with the tap water conduit 32 by a tap water supply pipe 44. As shown in FIG. 2, temperature mixing valve 42 has a second inlet 45 connected in communication with the hot water conduit 40 by a hot water supply pipe 46.

As shown in FIGS. 1, 2 and 11, the liquid preparing means can further desirably include a warm water conduit 48 that is connected in communication with a supply of warm water provided by the mixing valve 42. As shown in FIGS. 1 and 2, the mixing valve has an outlet 49 connected in communication with the warm water conduit 48 via a warm water supply pipe 50. As shown in FIG. 2, warm water conduit 48 is also connected to one end of a warm water branch pipe 52. The other end of the warm water branch pipe 52 is connected to a warm water inlet port 54 formed in the top of recirculation tank 24. As shown in FIG. 1, warm water branch pipe 52 is carried by the support frame 26 that defines the flushing module 22. As schematically shown in FIGS. 2 and 3, a warm water solenoid valve 56 is disposed in communication with warm water conduit 48 and warm water inlet port 54 of recirculation tank 24 so as to be operable to regulate the amount of warm water permitted to flow from warm water conduit 48 to warm water inlet port 54 of recirculation tank 24. Warm water valve 56 enables warm water inlet port 54 to be selectively connectable in communication with warm water conduit 48.

The use of predetermined volumes of liquids has certain advantages. For example, the use of measured volumes of liquid avoids inconsistencies that otherwise would arise from supply pressure line fluctuations when liquid is added only on a timed basis. In accordance with the present invention, a means can be provided to monitor the level of liquid contained inside the recirculation tank. As embodied herein and shown in FIGS. 2–4, the recirculation tank liquid level monitoring means desirably can include a high level liquid sensor 58 configured and disposed to detect a predetermined high level of liquid contained inside recirculation tank 24. The recirculation tank liquid level monitoring means also desirably can include a low level liquid sensor 59 configured and disposed to detect a predetermined low level of liquid contained inside recirculation tank 24. A suitable embodiment of each recirculation tank level sensor 58, 59 is a float-type reed switch. Thus, the present invention uses level sensors to make volumetric determinations of the amount of liquid to be used in the different cycles of operation.

As shown in FIGS. 1, 2 and 11, the liquid preparing means further desirably can include a chemical conduit 50 that is disposed selectively in communication with a supply of chemical. As schematically shown in FIG. 2, the liquid preparing means desirably can include a chemical reservoir 62 and a chemical metering pump 64. The chemical reservoir is configured for containing a chemical including a detergent and/or a disinfectant. A ten-gallon container provides a suitable chemical reservoir 62, which also can be provided in the form of a one-gallon supply jug or a five-gallon container. An example of a suitable chemical is the detergent/disinfectant known as UNICIDE TM, which is a combination of detergent, disinfectant-biocide and softening agent. The chemical reservoir 62 is connected to an inlet of the chemical metering pump 64 by a first chemical supply pipe 63. The outlet of the chemical metering pump 64 is connected in communication with the chemical conduit 60 via a second chemical supply pipe 65. Operation of the chemical metering pump 64 selectively permits the supply of chemical stored in chemical reservoir 62 to be pumped into chemical conduit 60.

In further accordance with the present invention, a means can be provided to monitor the level of chemical contained inside the chemical reservoir. As embodied herein and shown in FIGS. 2 and 3, the chemical level monitoring means for the chemical reservoir desirably can include a low level liquid chemical sensor 61 configured and disposed to detect a predetermined low level of chemical contained inside chemical reservoir 62. A suitable embodiment of low level liquid chemical sensor 61 is a float-type reed switch. This is another instance in which the present invention uses level sensors to make volumetric determinations of the amount of liquid to be used during a cycle of operation of the flushing module. In this case, chemical sensor 61 provides information that can be used: (1) to reduce the chance that the chemical metering pump loses its prime and (2) to ensure that there is enough chemical to complete a cycle of operation.

As shown in FIG. 2, chemical conduit 60 is connected to one end of a chemical branch pipe 66. The other end of the chemical branch pipe 66 is connected to a chemical inlet port 68 formed in the top of recirculation tank 24. As shown in FIGS. 1 and 2, chemical branch pipe 66 is carried by the support frame 26 that defines the flushing module 22. A chemical solenoid valve 70 is disposed in communication with chemical conduit 60 and chemical inlet port 68 of recirculation tank 24 so as to be operable to regulate the amount of chemical permitted to flow from chemical conduit 60 to the chemical inlet port of recirculation tank 24. Chemical solenoid valve 70 enables chemical inlet port 68 to be selectively connectable in communication with chemical conduit 60.

A bronze one inch diameter 24 volt AC solenoid valve is a suitable embodiment for each of tap water solenoid valve 38, warm water solenoid valve 56, and chemical solenoid valve 70. However, industrial grade polyvinyl chloride solenoid valves also could be used for each of valves 38, 56, and 70. As shown in FIG. 2, two cross-connection, back-flow regulator valves 72, 73 can be provided. One back-flow regulator valve 72 is configured to be disposed between the service center facility's tap water line 74 before it ties into the module's tap water conduit 32. The other back-flow regulator valve 73 is configured to be disposed between the service center facility's hot water line 75 before it ties into the module's hot water conduit 40. Each cross-connection, back-flow regulator valve prevents the possibility of contaminating material from the bed being drawn back into the public utility water supply. A Series 007 Double Check Valve Backflow Preventer available from WATTS REGULATOR® of Andover, Mass., provides a suitable cross-connection, back-flow regulator valve. One pair of these valves can suffice for each facility used to house one or more modules 22.

In further accordance with the present invention, a means is provided for supplying liquid to at least one of the internal surfaces that is exposed to one or more substances associated with the care, maintenance, or treatment of a patient and for removing liquid supplied to at least one of the internal surfaces exposed to one or more substances associated with the care, maintenance, or treatment of a patient. As embodied herein and schematically shown in FIGS. 2 and 3, the liquid supplying and removing means desirably includes a recirculation pump 76 connected in communication with recirculation tank 24. The recirculation pump 76 is the main pump and desirably is a progressive cavity pump rated at one-third horsepower and operating on alternating current at 115 volts. While centrifugal pumps tend to lose their prime and lose flow on a regular basis, progressive cavity pumps tend to quickly reprime themselves in the event that an air leak allows a slug of air into the pump. To ensure adequate flow rates in all of the hoses, conduits, etcetera, of the system comprising the module 22 and bed 20 being cleaned, recirculation pump 76 desirably should generate a minimum suction of ten inches of mercury in order to adequately overcome all of the air leaks and friction losses in the system. A higher suction level on the system is desirable so long as the system's components are strong enough to permit use of higher vacuums. A suitable progressive cavity pump is a MOYNO® pump available from the Robbins and Meyers Company of Springfield, Ohio.

As schematically shown in FIG. 2, the liquid supplying and removing means can include a drain pipe 78 and a hose manifold 80 connected to one end of the drain pipe. The other end of the drain pipe 78 is connected to the outlet of recirculation tank 24. As schematically shown in FIGS. 2, 2A, and 3, an auxiliary electric heater 41 can be configured and disposed to heat the liquid flowing through drain pipe 78. The hose manifold 80 is connected in communication with each of one end of a first hose pipe 81, one end of a second hose pipe 82, and one end of a third hose pipe 83. As shown in FIG. 1, the opposite ends of the first, second, and third hose pipes 81, 82, 83, are connected respectively to one end of a first liquid supply hose 84, a second liquid supply hose 85, and a third liquid supply hose 86. As shown in FIG. 1, each of the opposite ends of the first, second and third supply hoses 84, 85, 86, is configured to be connected respectively to the drain opening in the basin 87 of the patient support device 20, the vacuum wand 88 of the patient support device 20, and the attachment port (not visible in the view shown in FIG. 1) for the waste collection jug 120 (not shown in FIG. 1) of the patient support device 20. Each of the connectors at the ends of first supply hose 84, second supply hose 85, and third supply hose 86 is detachable to enable it to be replaced with a connector that enables the hose or fitting to be connected to different beds having differently configured receptacles for such connectors. As shown in FIG. 2, the flow of liquid through each of the first, second, and third hose pipes 81, 82, 83, is regulated respectively by a first hose valve 91, a second hose valve 92, and a third hose valve 93. Each of the first, second, and third hose valves 91, 92, 93, is configured and disposed to regulate the flow of liquid between each respective first, second, and third supply hose 84, 85, 86 on the one hand, and the hose manifold 80 on the other hand. Thus, each respective first, second, and third supply hose 84, 85, 86 is selectively connectable in communication with hose manifold 80 and the outlet of the recirculation tank 24 by each of the respective first, second, and third hose valves 91, 92, 93. As schematically shown in FIG. 2, a suitable embodiment of each of the first, second and third hose valves 91, 92, 93, can be provided by a manually adjustable one inch PVC true union ball valve. However, in an alternative embodiment schematically shown in FIG. 3 in which one or more of the first, second and third hose valves 91, 92, 93, is/are required to be automatically opened and closed under the control of a controller (described below), a suitable embodiment of each of the first, second and third hose valves 91, 92, 93, can be provided by a bronze one inch diameter 24 volt AC solenoid valve or an industrial grade polyvinyl chloride solenoid valve. Moreover, the number of respective hose pipes, hose valves and supply hoses connected in communication with hose manifold 80, can be increased or decreased as required to service a particular bed configuration.

It is important that adequate liquid flow rates are maintained in each of the first, second and third supply hoses 84, 85, 86, to ensure turbulent liquid action against the soiled internal surfaces of the patient support device. It is important to detect leakage of liquids due to loose connections or component wear that may affect the efficiency of cleaning and disinfecting the soiled internal surfaces of the patient support device.

In still further accordance with the present invention, a means can be provided to monitor for at least one liquid flow rate that is adequate for promoting turbulent flow action to the patient support device's internal surfaces that become exposed to substances associated with the care, maintenance, and/or treatment of a patient. As embodied herein and shown in FIGS. 2 and 2A, the turbulent flow monitoring means can include at least a first hose flow rate sensor 94. Desirably, the turbulent flow monitoring means can include a second hose flow rate sensor 95 and a third hose flow rate sensor 96. As shown in FIGS. 2 and 2A, each respective hose flow rate sensor 94, 95, 96, desirably is configured and disposed to sense the rate of flow of liquid in each respective hose pipe 81, 82, 83. A suitable embodiment of a flow rate sensor 94, 95, 96, is provided in the form of a flow switch, which is basically a float that is lifted by the velocity of the liquid flowing through the switch. When sufficient liquid velocity occurs inside the switch, the liquid raises the float to a position that trips a magnetic reed switch to indicate that the flow is occurring. Such a flow switch can be installed in each one of the first, second, and third hose supply pipes 81, 82, 83, feeding the corresponding supply hoses 84, 85, 86. Each flow switch desirably has a flow rate capability that is at least the minimum amount of water that should go through each one of the supply hoses. By monitoring a particular flow switch, the operator can determine whether the corresponding supply hose is carrying an adequate amount of flow to clean the soiled surfaces of the patient support device being supplied with liquid by the supply hose in question.

As shown in FIGS. 2 and 2A, the liquid supplying and removing means desirably can include a suction pump pipe 98 that has one end connected to the inlet, i.e., suction side, of the recirculation pump 76. A suction pump hose valve 100 can be configured and disposed to permit a suction pump hose 102 to be selectively connectable in communication with the inlet of the recirculation pump 76. The suction pump hose valve 100 is connected in communication with the other end of the suction pump pipe 98 and is configured and disposed to regulate the flow of liquid between the suction pump hose 102 and the inlet (suction side) of the recirculation pump 76. A suitable embodiment of the suction pump hose valve 100 can be provided by a manually adjustable one inch PVC true union ball valve. A one and one half inch diameter PVC threaded check valve 103 of the spring loaded type desirably is disposed between the suction pump hose valve 100 and one end of the suction pump hose 102. Check valve 103 only permits liquid to flow in the direction of the arrow towards the inlet of recirculation pump 76.

As shown in FIGS. 2 and 2A, the liquid supplying and removing means desirably can include a pump outlet pipe 104 having one end connected to the outlet, i.e., discharge side, of the recirculation pump 76. A pump outlet valve 106 is configured and disposed to regulate the flow of liquid from the discharge side of the recirculation pump 76 and is disposed to regulate the flow from the pump outlet pipe 104. A suitable embodiment of the pump outlet valve 106 can be provided by a manually adjustable one inch PVC true union ball valve.

The liquid supplying and removing means can include a means for returning liquid to the recirculation tank. As shown schematically in FIGS. 2 and 2A, the recirculation tank liquid returning means can include a recirculation return solenoid valve 112 which is configured and disposed to regulate the flow of liquid between the discharge side of the recirculation pump 76 and the recirculation tank 24. The recirculation tank liquid returning means also can include a recirculation return pipe 110 connected in communication with recirculation return solenoid valve 112 and with a rinse ring 108 (FIG. 4) that can be disposed around the upper inside portion of the recirculation tank 24. Recirculation return pipe 110 can be connected in communication with a rinse ring pipe 111 (FIG. 4), which is inserted through a feedthrough opening into recirculation tank 24 and is connected to rinse ring 108. The rinse ring pipe 111 can be connected in communication with recirculation return solenoid valve 112, which is configured and disposed to regulate the flow of liquid between the outlet of the recirculation pump 76 and the rinse ring 108 via recirculation return pipe 110. The recirculation tank liquid returning means also can include a recirculation tank supply pipe 116, which is intersected by recirculation return pipe 110 and is thereby connected in communication with recirculation return solenoid valve 112. Recirculation tank supply pipe 116 can be connected in communication with rinse ring 108 and with a spray tree pipe manifold 115. As schematically shown in FIGS. 2, 2A and 3, a recirculation tank access valve 90 can be configured and disposed along the path of recirculation tank supply pipe 116 to regulate access to rinse ring 108 and spray tree pipe manifold 115. A bronze one inch diameter 24 volt AC solenoid valve or an industrial grade polyvinyl chloride solenoid valve is a suitable embodiment of the recirculation return solenoid valve 112 and for recirculation tank access valve 90. The low voltage is desirable for operating such valves in wet areas. However, valves operating on higher voltages, such as 120 volts AC, can be used safely as long as they are operated in appropriate conduit with appropriate fittings and ground fault protectors. As shown in FIG. 4, the rinse ring 108 has a plurality of holes 113 from which a continuous rinsing curtain of liquid can be returned to the recirculation tank 24 and impinges against the inside surface of the vertical wall 29 of the recirculation tank 24, to keep it clean.

At the desired concentrations of one ounce of detergent/disinfectant per gallon of warm water, a considerable amount of foaming can occur inside the recirculation tank 24 as the recirculating liquid containing detergent/disinfectant is returned to the recirculation tank. Since spray nozzles are very effective in breaking up foam, rather than returning liquid to the recirculation tank via a rinse ring 108 as shown in FIG. 4, an arrangement of spray nozzles can be provided. Accordingly, in an alternative embodiment of the recirculation tank liquid returning means shown in FIG. 6, the recirculating liquid is returned to the recirculation tank through an arrangement of spray nozzles 114 which are arranged to wash down the vertical sidewalls 29 of the tank 24. The high velocity jets of liquid coming from the spray nozzles 114 break up foam and prevent foam from accumulating in the recirculation tank 24.

Figure 6:
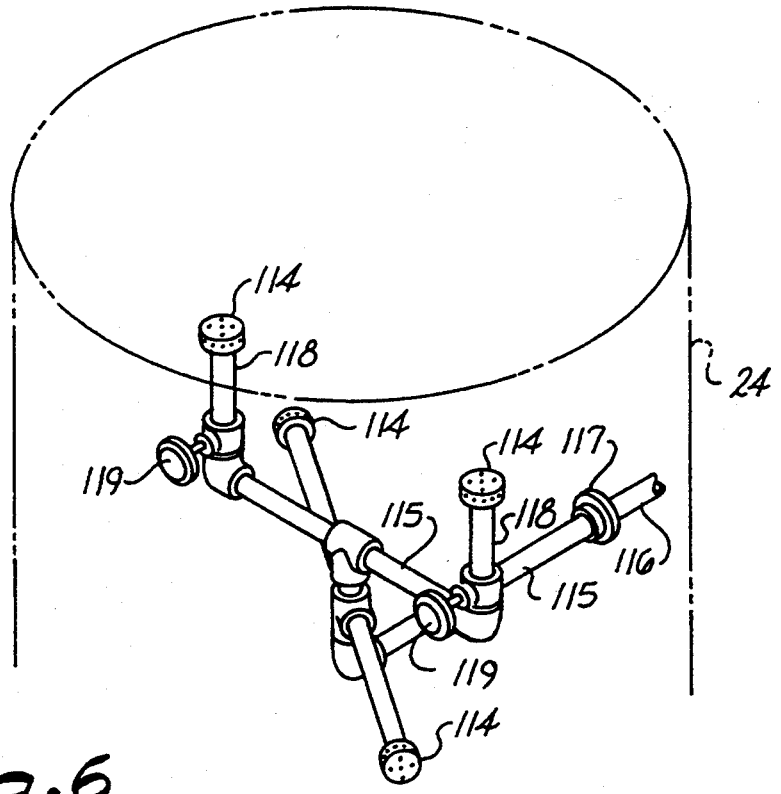
FIG. 6 is an elevated perspective view of portions of some of the components shown in FIGS. 4 and 5 and an alternative embodiment of certain components shown in FIG. 4.

In further accordance with the present invention, a means can be provided for cleansing the inside surfaces of at least one of the removable containers of the device. One such container is a jug 120 that collects the waste materials associated with one or more of the care, maintenance, and/or treatment of the patient supported in the patient support device. As embodied herein and shown in FIGS. 2, 2A and 6 for example, the removable container internal cleansing means desirably can include at least one spray tree pipe manifold 115 disposed within the upper portion of recirculation tank 24. The recirculation return pipe 110 can be connected in communication with a recirculation tank supply pipe 116, which is inserted through a feedthrough 117 (FIG. 6) into recirculation tank 24 and connects to spray tree pipe manifold 115, which branches into at least two vertically disposed wands 118. Each wand 118 is configured and disposed to receive at least one of the removable containers of the device 20 and is connected in communication with the liquid supplying and removing means. The recirculation tank supply pipe 116 is connected in communication with the recirculation return solenoid valve 112 which is configured and disposed to regulate the flow of liquid from the outlet of the recirculation pump 24 to the spray tree wands 118. As shown in FIGS. 4 and 6, liquid flow to each wand 118 is independently regulated by a separate manually operated valve 119, so that each wand can be used individually or both wands can be used together to clean one or two waste collection jugs 120 at one time. The free end of each wand 118 is configured in the form of a spray nozzle 114.

In further accordance with the present invention, the liquid supplying and removing means desirably can include a means for cleansing the internal surfaces of at least one of the containers of the device. As embodied herein and shown in FIG. 2, the means for cleansing the internal surfaces of at least one of the containers of the device desirably can include a spray nozzle hose 122 that is selectively connectable in communication with a spray nozzle pipe 123 via a spray nozzle hose valve 124. A suitable embodiment of the spray nozzle hose valve 124 can be provided by a manually adjustable one inch PVC True Union Ball Valve. Spray nozzle pipe 123 is connected in communication with recirculation tank supply pipe 116. Accordingly, recirculation return solenoid valve 112 is configured and disposed to regulate the flow of liquid from the outlet of the recirculation pump 24 to spray nozzle hose 122.

Figures 7, 8:
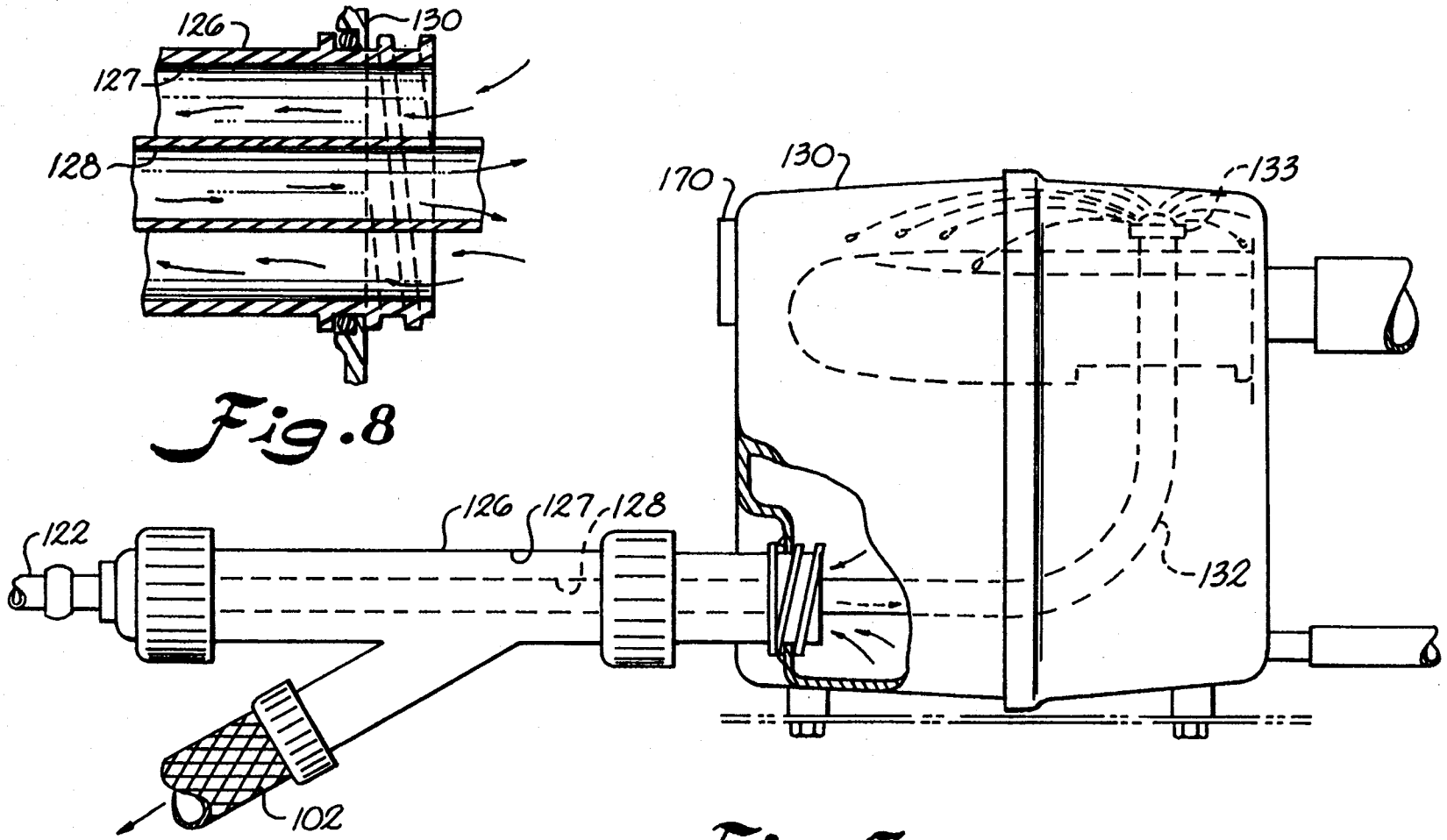
FIG. 7 is a side plan view with portions cut away and portions shown in phantom (dashed line) of preferred embodiments of components of the present invention.
FIG. 8 is a cross-sectional view of certain of the components shown in FIG. 7.

As embodied herein and shown in FIGS. 1–3 and 7, the means for cleansing the internal surfaces of at least one of the containers of the device desirably can include a concentric Y-fitting 126. As shown in FIG. 7, concentric Y-fitting 126 desirably can be configured with a first fluid passage 127 and a second fluid passage 128 disposed concentrically with respect to the first fluid passage 127. One of the suction pump hose 102 and the spray nozzle hose 122 desirably is selectively connectable in communication with the first fluid passage 127. The other of the suction pump hose 102 and the spray nozzle hose 122 desirably is selectively connectable in communication with the second fluid passage 128. As shown in FIGS. 7 and 8, the free end of Y-fitting 126 is configured to be connected into an opening of the separator tank 130 of the patient support device 20. The connector at this free end of concentric Y-fitting 126 is desirably detachable to enable it to be replaced with a differently configured connector that enables the fitting 126 to be connected to different beds having a mating connector. As shown in the embodiment of FIGS. 7 and 8, the free end of the Y-fitting 126 is desirably threaded to be screwed into the opening provided in the separator tank 130. The second fluid passage 128 leads into a spray nozzle configured to be disposed inside at least one of the containers of the device and connected in communication with the liquid supplying and removing means. As shown in FIG. 7, near the free end of the second fluid passage 128, a curved conduit 132 is configured with a nozzle 133 at the free end thereof so that liquid from the discharge side of the recirculation pump 76 is supplied under pressure to the second fluid passage 128 and is sprayed out of the openings in the nozzle 133 disposed inside the patient support device's separator tank 130. This spray washes down the internal walls of the separator tank 130. The other end of the second fluid passage 128 is connected in communication with the spray nozzle hose 122. The other end of the first fluid passage 127 is connected in communication with the suction pump hose 102. As shown in FIG. 8, liquid is sucked into the first fluid passage 127 by the vacuum created at the inlet of the recirculation pump 76. Similarly, liquid is forced out of the second fluid passage 128 under the positive pressure provided at the outlet of the recirculation pump 76. As shown schematically in FIGS. 2 and 2A, the spray nozzle hose valve 124 is configured and disposed to regulate the flow of liquid from the outlet of the recirculation pump 76 to the spray nozzle hose 122 and to the second fluid passage 128 of the Y-fitting 126.

In further accordance with the present invention, an alternative embodiment of the supplying and removing means can be configured to supply liquid to the bed's internal chambers, conduits and the like with the aid of an additional pressure head. This alternative embodiment of the supplying and removing means is shown schematically in FIG. 2A and is similar to the embodiment shown in FIGS. 2 and 3 for example, except for three additional pipes 181, 182, and 183, and six additional valves 191, 192, 193, 194, 195, and 196. As schematically shown in FIG. 2A, one end of a first pressure path pipe 181 is connected in fluid communication with a branch of recirculation tank supply pipe 116, and the opposite end of first pressure path pipe 181 is connected in fluid communication with hose manifold 80. As schematically shown in FIG. 2A, a first pressure path valve 191 is configured and disposed along first pressure path pipe 181 to regulate the flow of fluid through first pressure path pipe 181.

As schematically shown in FIG. 2A, a second pressure path pipe 182 has a first end connected in fluid communication with recirculation tank supply pipe 116, and a second end of second pressure path pipe 182 is connected into fluid communication with suction pump pipe 98 at a location along suction pump pipe 98 that is the node where hose manifold 80 intersects with suction pump pipe 98. A second pressure path valve 192 is disposed along the length of second pressure path pipe 182 in a configuration that enables second pressure path valve 192 to control the flow of fluid through second pressure path pipe 182. As schematically shown in FIG. 2A for example, recirculation tank access valve 90 is disposed along the length of recirculation tank supply pipe 116 between where recirculation tank supply pipe 116 intersects with second pressure path pipe 182 and enters recirculation tank 24 on the one hand and the node where recirculation return pipe 110 intersects with recirculation tank supply pipe 116.

As schematically shown in FIG. 2A, one end of a third pressure path pipe 183 is connected in fluid communication with drain pipe 78, and the opposite end of third pressure path pipe 183 is connected in fluid communication with suction pump pipe 98 at a location along pipe 98 that is between recirculation pump 76 and the node where hose manifold 80 intersects with suction pump pipe 98. As schematically shown in FIG. 2A, a third pressure path valve 193 is configured and disposed along third pressure path pipe 183 to regulate the flow of fluid through third pressure path pipe 183.

As schematically shown in FIG. 2A for example, a fourth pressure path valve 194 is disposed along the length of drain pipe 78 at a location that is between the node where third pressure path pipe 183 intersects with pipe 78 and the node where pipe 78 intersects with hose manifold 80. Thus, fourth pressure path valve 194 is disposed to control the flow of fluid through drain pipe 78 so as to isolate hose manifold 80 from drain pipe 78.

As schematically shown in FIG. 2A for example, a fifth pressure path valve 195 is disposed along the length of suction pump pipe 98 at a location that is between the node where pipe 98 intersects with third pressure path pipe 183 and the node where hose manifold 80 intersects with pipe 98. Thus, fifth pressure path valve 195 is disposed to control the flow of fluid through suction pump pipe 98 and to isolate the inlet or suction side of pump 76 from hose manifold 80 and from suction pump hose 102.

As schematically shown in FIG. 2A for example, a drain conduit access valve 196 is disposed in drain surge feeder pipe 138 between where auxiliary drain surge auxiliary tank feeder pipe 155 intersects with drain surge feeder pipe 138 and where drain surge feeder pipe 138 intersects with a branch of recirculation tank supply pipe 116. Thus, drain conduit access valve 196 is configured and disposed to control the flow of fluid through that branch of drain surge feeder pipe 138 heading toward drain surge tank 142. Drain conduit access valve 196 can combine with auxiliary drain surge tank valve 152 to isolate drain conduit 140 from the rest of the fluid in the module 22. Each of drain conduit access valve 196 and the first through fifth pressure path valves 191, 192, 193, 194, and 195, can be either manual valves or electrically actuated solenoid valves. As schematically shown in FIGS. 2, 2A and 3, a suitable embodiment of each of drain conduit access valve 196 and the first through fifth pressure path valves 191, 192, 193, 194, and 195, can be provided by an electric solenoid valve such as a bronze one inch diameter 24 volt AC solenoid valve or an industrial grade polyvinyl chloride solenoid valve.

In yet further accordance with the present invention, a means is provided for disposing of the liquid that is removed from at least one of the internal surfaces that is exposed to substances associated with the care, maintenance and/or treatment of a patient in a patient support device. As embodied herein and shown in FIGS. 1, 2, 2A and 3, the liquid disposing means desirably can include a primary drain surge tank solenoid valve 136, a drain surge feeder pipe 138, a drain conduit access valve 196, a drain conduit 140, a drain surge tank inlet pipe 141, a drain surge tank 142, and a drain surge tank outlet pipe 143. As schematically shown in FIGS. 2, 2A and 3, a suitable embodiment of primary drain surge tank solenoid valve 136 can be provided by an electric solenoid valve such as a bronze one inch diameter 24 volt AC solenoid valve or an industrial grade polyvinyl chloride solenoid valve. Drain surge tank 142 desirably is formed as a 30 gallon capacity cone bottom polyethylene tank having an 18-inch diameter and a thirty-inch straight side. As shown in FIG. 1, drain surge tank 142 is disposed within the support frame 26 of the flushing module 22. Drain surge tank 142 has an inlet port 144 connected to one end of the drain surge tank inlet pipe 141, which has an opposite end connected to drain conduit 140. The outlet port at the vertex of the cone portion of drain surge tank 142 is connected to one end of the drain surge tank outlet pipe 143, which has an opposite end connected to the sewer line (not shown) of the facility where the flushing module 22 is located. As shown in FIGS. 2 and 2A, primary drain surge solenoid valve 136 regulates the flow of liquid between the outlet of recirculation pump 76 and the drain surge tank 142 via the drain surge feeder pipe 138, the drain conduit 140, drain conduit access valve 196, and the drain surge tank inlet pipe 141. As shown in FIGS. 2 and 2A, drain conduit access valve 196 regulates the flow of liquid between the outlet of recirculation pump 76 and the drain conduit 140 via a branch of the drain surge feeder pipe 138. Drain conduit access valve 196 also regulates the flow of liquid between a branch of the recirculation tank supply pipe 116 and the drain conduit 140 via a branch of the drain surge feeder pipe 138. The liquid disposing means also can desirably include a one and one half inch diameter PVC threaded check valve 146 of the spring loaded type, which desirably is disposed in the drain surge feeder pipe 138 downstream of drain conduit access valve 196 and upstream of where feeder pipe 138 connects into drain conduit 140. Check valve 146 only permits liquid to flow in the direction of the arrow towards the drain conduit 140.

As schematically shown in FIG. 2, the liquid disposing means also can desirably include an auxiliary drain surge tank valve 152, a flow strainer 154, and an auxiliary drain surge tank feeder pipe 155. When the strainer 154 becomes clogged and it is desired to unclog it, the operator manually opens auxiliary drain surge tank valve 152 and a hose manifold valve 156. The hose manifold valve 156 is configured and disposed to permit selective communication between the hose manifold 80 and the inlet of the recirculation pump 76. A suitable embodiment of each of auxiliary drain surge tank valve 152 and the hose manifold valve 156 can be provided by a manually adjustable one inch PVC true union ball valve. By opening the auxiliary drain surge tank valve 152, the operator can backwash the strainer 154 to dislodge the blockage, without the operator having to come into contact with solid or liquid waste.

Figure 9:
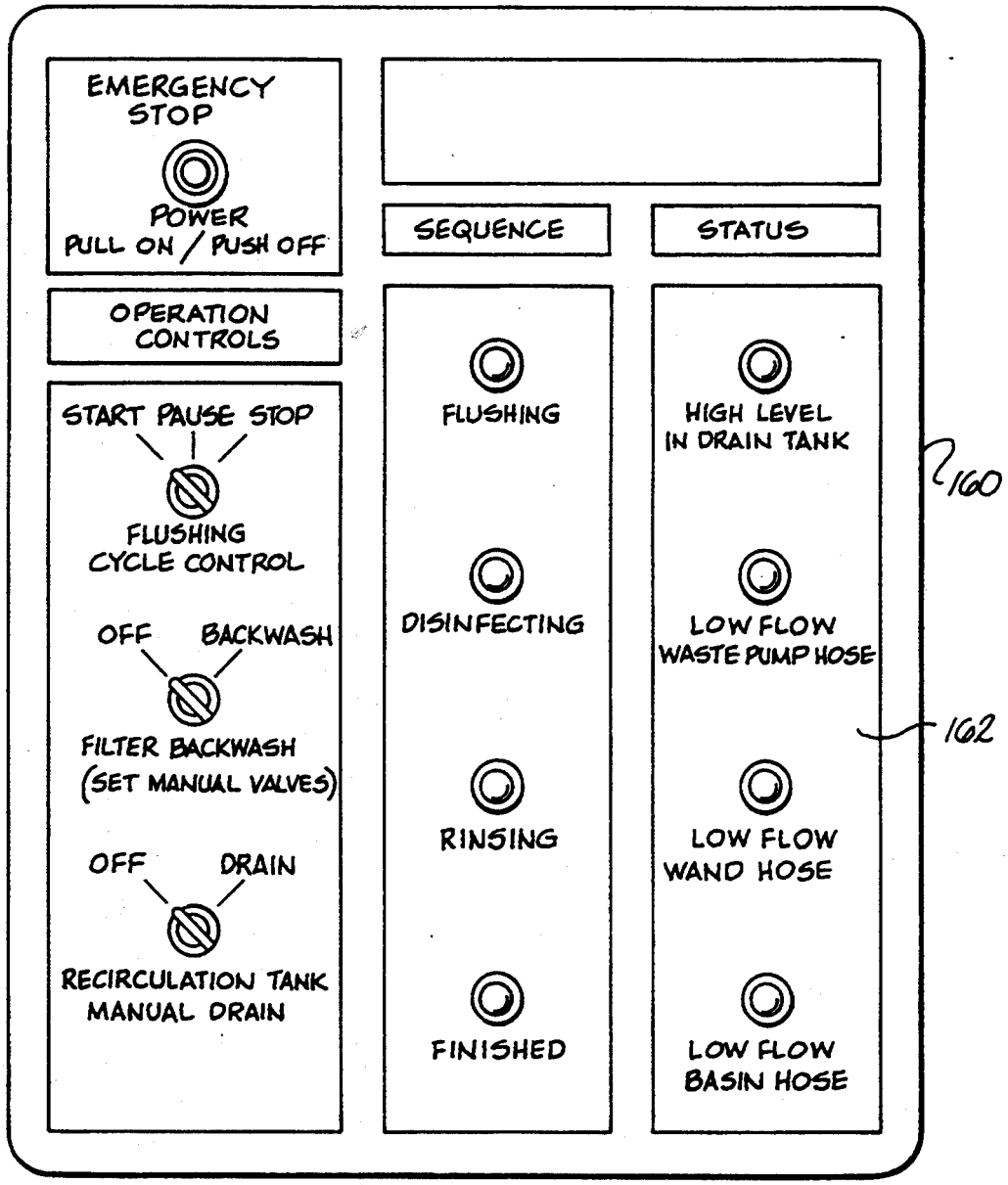
FIG. 9 is a front plan view of a preferred embodiment of a component of the present invention.

In yet further accordance with the present invention, a means can be provided for automatically controlling the operation of at least the liquid preparing means, the liquid supplying and removing means, and the liquid disposing means in a predetermined sequence of operations. As embodied herein and shown schematically in FIGS. 2A and 3 for example, the automatic controlling means desirably can include a controller 160 and a control panel 162 connected in electrical communication with the controller. As shown in FIG. 9 for example, indicator lights on the front panel 162 of controller 160 provide the operator with the following two types of information: (1) the current step in the operating sequence, and (2) the status of any alarm or error conditions. For example, as shown in FIG. 9, several lights disposed beneath the "STATUS" heading on the control panel 162 indicates to the operator the source of any alarm or error conditions. The controller desirably includes a microprocessor 164 that is preprogrammed with the desired predetermined sequence of operations for the flushing module 22. A suitable controller is the model SLC 500 available from the Allen-Bradley Company of Milwaukee, Wis.

This controller opens and closes solenoid valves and turns pumps on and off according to the desired predetermined operating sequence of the flushing module 22. As schematically shown by the solid lines in FIG. 3 for example, the controller 160 is electrically connected to control chemical metering pump 64 and recirculation pump 76. As schematically shown by the solid lines in FIG. 3 for example, the controller 160 is electrically connected to control each of the solenoid valves, including tap water solenoid valve 38, the warm water solenoid valve 56, the chemical solenoid valve 70, the chemical metering pump 64, the recirculation pump 76, the recirculation return solenoid valve 112, recirculation tank access valve 90, drain conduit access valve 196, the primary drain surge tank solenoid valve 136, and the lock-out valve 149. In an embodiment schematically shown in FIG. 3 in which each of first, second, and third hose valves 91, 92, and 93, is a solenoid valve, controller 160 is electrically connected to control each of them. In an embodiment schematically shown in FIG. 2A, each of first, second, third, fourth, and fifth, pressure path valves 191, 192, 193, 194, and 195, respectively, can be a solenoid valve. And in that event, controller 160 is electrically connected to control each respective electric solenoid valve 191, 192, 193, 194, and 195, via electrical cables, which are schematically represented in FIG. 2A by the solid lines designated 201, 202, 203, 204, and 205, respectively.

In still further accordance with the present invention, a means is provided for automatically monitoring for reliable cleaning of the soiled internal surfaces of the patient support device. As embodied herein, the automatic reliability monitoring means desirably can include controller 160 and control panel 162 connected in electrical communication with the controller. Controller 160 desirably includes a microprocessor 164 that can be programmed and electrically connected to receive information from level sensing devices, flow sensing devices, and the bed's controller, and can be preprogrammed to take this information into account when opening and closing solenoid valves, turning pumps on and off and turning an auxiliary heater on and off, according to the desired predetermined operating sequence of the flushing module 22. As schematically shown by the solid lines in FIG. 3 for example, the controller 160 is electrically connected to control auxiliary electric heater 41 and to receive information from the recirculation tank's high level liquid sensor 58 and low level liquid sensor 59, the chemical level sensor 61 on chemical reservoir 62, the first, second and third hose flow rate sensors 94, 95, and 96, respectively, and the drain surge tank's high level liquid sensor 148. The controller can be preprogrammed to use this information received from one or more of the bed's controller, the module's flow rate sensors and liquid level sensors, to determine whether to alter the normally desired predetermined sequence of operations. In the case of the low level liquid chemical sensor 61 for example, controller 160 is desirably preprogrammed to prevent the start of the cleaning cycle if sensor 61 signals inadequate chemical in reservoir 62 to complete an operating cycle.

When the recirculation pump 76 is running and the control panel 162 indicates that the pump is running, the operator wants assurance that each of the supply hoses 84, 85, 86, is getting an adequate amount of flow and that the entire bed 20 is being provided with sufficient liquid to generate a turbulent flow condition over the internal soiled surfaces of the patient support device. In further accordance with the present invention, each flushing module can be provided with a means of alerting the operator when flow through at least one liquid supply hose becomes less than a predetermined amount of flow. This reduced flow may indicate that a supply hose has become partially blocked for example. When the flow detected by one of the first, second or third hose flow rate sensors is low enough to activate the sensor and send a signal to the controller, the controller activates an alarm signal on the "STATUS" column of control panel 162 corresponding to the hose pipe with the low flow. The alarm signal generated on the control panel serves to direct the operator to look at the pipe, hose or the like corresponding to the alarm to find the cause of the low flow condition. Moreover, if any of the liquid flow rate sensors detects less than the desired amount of liquid flow in any one of the pipes connecting the hose manifold to the first, second and third supply hoses, the corresponding sensor sends a signal to the controller, which can be programmed to turn off the recirculation pump 76. The alarm light on the control panel identifies the particular supply hose that occasioned the tripping of the flow rate sensor and resulting shut down of the module's operation. To prevent nuisance trips of the flow rate sensors from occurring when a transitory diminution in flow occurs, the microprocessor desirably is programmed so that the inadequate flow must persist for a short period of time, such as 10 seconds or longer, before the controller will turn on the alarm and turn off the pump 76 to halt the process.

Corrosion resistant, non-rusting materials desirably are used for all pipes, fittings, pumps, filters, tanks and sensors, to prevent rust or other corrosion that might lead to leakage, or to staining of the patient support device and its systems.

Since the flushing module uses electricity in surroundings where water is prevalent, the flushing module is designed with two primary electrical safety features. First, because the pumps need a 115 volt power source to generate the necessary horsepower, each flushing module 22 is designed to plug into a ground fault interrupter receptacle. In the event there is a short to water or the possibility of electrical hazard in the area, the ground fault receptacle will trip, making the area safe. Second, water-tight enclosures are provided for electrical components. All the wiring to the pumps is run through water-tight electrical conduit to prevent accidental contact with electricity. All of the control wires to the hose flow rate sensors and the solenoid valves are either 24 volt AC or DC. These low voltage controls do not pose an electrical shock hazard. The microprocessor and control wiring terminals are in a water-tight electrical enclosure which includes the control panel 162. Also the pilot lights and switches that are on the control panel forming the front of that enclosure, are designed to be water-tight. This is additional protection against the electrical hazard that might result if a broken line or something of that sort were to spray the module with water.

In yet further accordance with the present invention, a means can be provided for safeguarding personnel against routine contact with substances associated with the care, maintenance, and treatment of patients in the devices being cleaned. As embodied herein and schematically shown in FIGS. 1 and 11 for example, the personnel safeguarding means can include a supplemental containment basin 25, which is indicated in phantom by the dashed lines so as to not to obscure other components of modules 22. Each supplemental containment basin 25 can include an open top tank which receives a flushing module 22 and is constructed of one or more of the materials selected from the group including fiberglass, polyethylene, galvanized steel or stainless steel. Each supplemental containment basin 25 desirably is constructed with a depth of approximately six inches and a length and width approximately six inches greater than the corresponding dimension of the exterior support frame 26 of each flushing module 22. As schematically shown in phantom in FIG. 1, casters 27 can be disposed beneath basin 25 to carry basin 25 and frame 26 of module 22. Basin 25 is disposed and configured to collect any leaks or overflows resulting from any malfunction that might otherwise spill liquids onto the floor beneath module 22. By collecting such spills, basin 25 provides an added measure against the possibility that inadequately disinfected materials might flow into clean areas of the facility which houses each module 22. As shown in phantom in FIG. 1 for example, a valve 23 provides a means for draining basin 25.

The personnel safeguarding means also can include an automated drain shut-off device. As embodied herein and schematically shown in FIGS. 2, 2A, and 3 for example, a lockout valve 149 is disposed in the drain surge tank outlet pipe 143 that is connected in communication with the sewer line of the facility that houses module 22. As schematically shown in FIG. 3 for example, lock-out valve 149 is an electrical solenoid valve which is electrically connected to controller 160. Desirably, lock-out valve 149 is normally closed unless power is provided to open it, and controller 160 is preprogrammed to automatically open lock-out valve 149 at the start of each cleaning cycle. Controller 160 desirably is further programmed to retain lock-out valve open for a timed interval of approximately ten minutes after the completion of each cleaning cycle. Controller 160 also is desirably programmed to close lock-out valve immediately in the event of an emergency shut down of the system or in the event of a loss of power to the system. By means of a switch 151 schematically shown in FIG. 3, personnel from the local public utility can disable the electrical connection by which controller 160 provides the power required to open lock-out valve 149. This will ensure that any discharge to the sewer from drain surge tank 142 via drain surge tank outlet pipe 143 is prevented during such times as the local public utility is conducting sewer line maintenance for example. Moreover, in view of the capacity of drain surge tank 142, the apparatus of the present invention is capable of cleaning and disinfecting at least one bed even though lock-out valve 149 is closed and prevents liquid from draining from drain surge tank 142 into the sewer serving the facility where module 22 is operating.

When the drain surge tank solenoid valve 136 and drain conduit access valve 196 are open, the operator wants assurance that liquid spills and backups will not occur if the gravity drain line to the sewer becomes blocked. In accordance with the present invention, the personnel safeguarding means also can include a means of coping with sewer blockages. For example, each flushing module can include a means for monitoring the level of liquid contained inside the drain surge tank. As embodied herein, the liquid level drain surge tank monitoring means desirably can include a high level liquid sensor 148 configured and disposed to detect a high level of liquid contained inside drain surge tank 142. A suitable embodiment of high level liquid sensor 148 is provided by the same type of sensor used for high level liquid sensor 58 for the recirculation tank. Moreover, a means is provided for alerting the operator and interrupting the operating sequence of the flushing module when the drain surge tank becomes filled near capacity. If the drain surge tank 142 becomes nearly full, the high level liquid sensor 148 near its top rim will send a signal to the controller 160. In response to this signal, the controller can be programmed to illuminate a light labelled "HIGH LEVEL IN DRAIN TANK" or the like on the control panel 162 to alert the operator to the undesirable condition. In addition, the controller can be programmed to cause the flushing module 22 to pause in its operating sequence, shutting off all solenoid valves and turning off all pumps. This prevents a spill by preventing additional liquid from coming into the system or being pumped into the drain surge tank. It also requires the operator to check the control panel and investigate the cause of the shutdown before resetting the flushing module to resume its operating mode.

As embodied herein, drain surge tank 142 provides a safety factor when handling discharged wastes by having approximately two times the capacity of the largest volume of liquid used in any step of the operating sequence of the flushing module. This is another instance of an advantage attributable to the use of controlled volumes of liquids in carrying out the various operating cycles of the flushing module. If a blockage in the sewer line should occur, the entire charge of liquid in the flushing module at the time of the blockage can be discharged to the surge drain tank 142 without causing the surge drain tank to overflow in the service center and contaminate the floor and cause a messy clean-up problem. As explained above, if the operator fails to recognize that the level is rising in the drain surge tank and continues to try to decontaminate additional beds, the high level liquid sensor 148 is tripped, and controller 160 shuts off all solenoid valves and all pumps.

As shown in FIG. 1, the personnel safeguarding means also can include a lid 150 hingedly attached to cover at least a portion of the top of drain surge tank 142. The lid and hinging arrangement is the same as shown in FIGS. 4 and 5 for recirculation tank 24. The lid prevents splashing and keeps aerosol mists inside the drain surge tank 142 so that they do not contaminate the area surrounding the flushing module 22. In this way, lid 150 functions as a means for safeguarding personnel against routine contact with substances associated with the care, maintenance, and treatment of patients in the devices being cleaned.

Each facility which houses flushing modules 22 as shown in FIGS. 1 and 11 is desirably equipped with the following electrical/plumbing facilities:

1) A work area with 5'×5' of floor space and at least 8 feet of height clearance for each flushing module 22. The work area should have enough room to receive a patient support device to be cleaned so that such device can be parked in front of this work area for periods of up to 1 hour at a time without interfering with normal work processes of the surrounding area.
2) The work area must have access to a single 120 Volt AC 20 amp GFI receptacle electrical outlet of the NEMA type L5-20, or Hubble Model 4A259.

3) Each work area should have access to a 4 inch. diameter PVC drain line tied into the main sewer line. A 4"×4"×2" Single Sanitary Tee Branch desirably is installed 24 inches from the floor surface. From the Tee Branch, a 4 inch diameter line should continue through the roof as a vent. An easily accessible "CLEAN OUT" should be located near this Tee Branch. If using a crawl space to run the drain line to the main sewer line, the clean out can be located inside the crawl space.
4) Each work area should have access to a cold water 1 inch or ¾ inch diameter PVC line with a shut off valve placed 4 feet from the floor surface and a 4 inch stub out at 3 feet from the floor surface.
5) A 40 to 80 gallon quick recovery water heater can be used to supply the facility with hot water for hot water conduit 40, which may be a hot water 1 inch or ¾ inch diameter PVC line with a shut off valve placed 4 feet above the floor surface and a 4 inch stub out at 3 feet from the floor surface. Insulation wrap should cover the line from the water heater to the stub out. Proper identification should be provided to label it as the "HOT WATER LINE".

Figure 10:
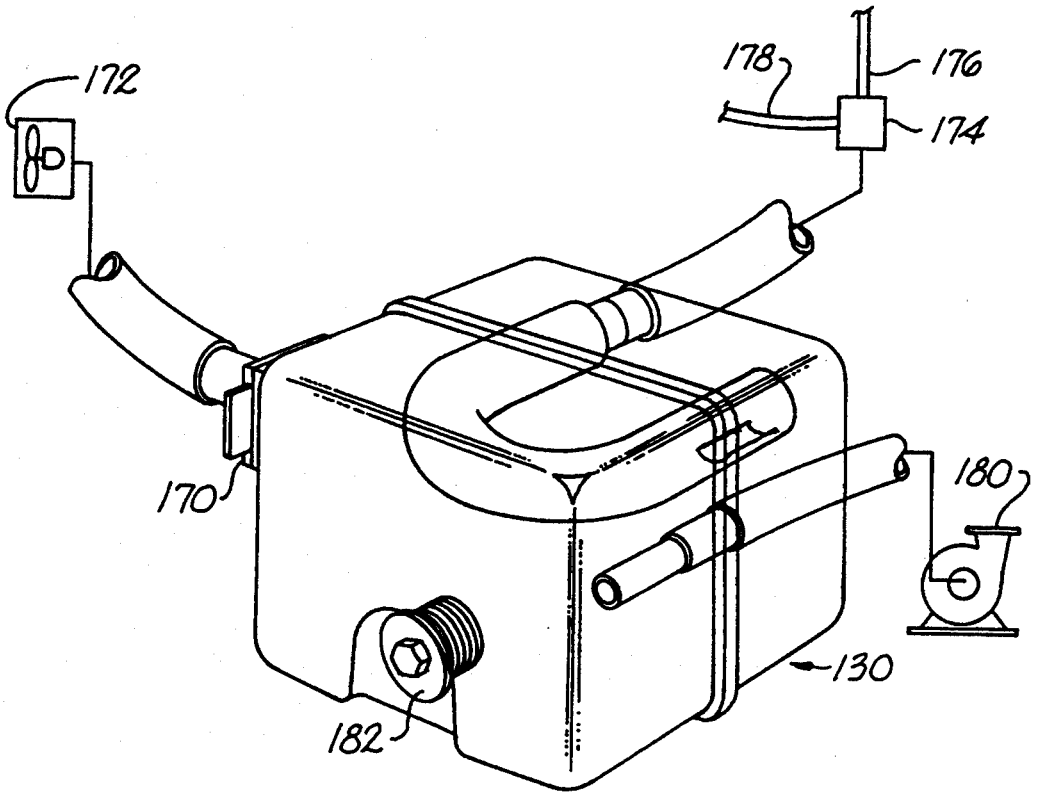
FIG. 10 schematically illustrates internally disposed components of a patient support device to be subjected to the present invention.

In accordance with the present invention, the flushing module can be operated as follows to clean and disinfect the soiled internal workings of a patient support device. The patient support device 20 may need to be placed into a configuration that is optimum for being cleaned and disinfected by the flushing module of the present invention. For example, as shown in FIG. 1, the operator desirably lowers the CLENSICAIR ® bed 20 to its lowest position to aid the flow of liquids into the bed to prime the recirculation pump of the flushing module. As shown in FIGS. 7 and 10, the operator closes the slide gate valve 170 between the bed's separator tank 130 and the bed's air blower 172 (not shown in FIG. 7) to prevent liquids from inadvertently entering the blower. The operator addresses the control panel of the bed and activates the bed's flushing/cleaning mode, wherein the bed's diverter valve 174 (FIG. 10) opens for full flow in both the bed's basin drain pipe 176 and vacuum wand line 178. Additionally, in the bed's flushing/cleaning mode, the bed's waste pump 180 is turned on to force liquid through the waste pump lines and into the separator tank 130. In an embodiment in which the bed's controller is connected in communication with controller 160 of the flushing module 22 via cable 166 and connector 168 such as shown schematically in FIG. 3, the module's controller 160 can be programmed to operate through the bed's controller to effect these changes in the bed's configuration and status without operator involvement.

In further accordance with the present invention, the flushing module must be connected to the patient support device. As shown in FIG. 1, the operator connects four hoses from the flushing module 22 to the CLENSICAIR ® bed 20. As shown in FIG. 1, the operator connects a first supply hose 84 to the drain pipe 176 (FIG. 10) leading from the basin 87 of the bed 20, a second supply hose 85 to the vacuum wand 88 of the bed, a third supply hose 86 to the waste pump 180 (FIG. 10) of the bed, and a suction pump hose 102 to the separator tank 130 of the bed. As shown in FIGS. 1 and 7, suction pump hose 102 and pressurized spray nozzle hose 122 connect to concentric Y-fitting 126 which is connected to the opening in separator tank 130 that is normally closed by a threaded plug 180 (FIG. 10). Spray nozzle hose 122 is a pressurized line that connects to spray nozzle 133, which is coaxial with the first fluid passage 127 of Y-fitting 126 connected to the separator tank 130. Spray nozzle hose 122 carries flushing, cleaning and rinsing liquids to the inside top and walls of the bed's separator tank 130 to ensure thorough cleaning of the inside of the separator tank 130. As shown in FIG. 4, the operator places a waste collection jug 120 over a wand 118 and opens the valve 119 which will allow liquid to flow through the nozzle 114 at the end of the wand during operation of the flushing module 22.

In preparing to initiate operation of the flushing module embodiment shown in FIGS. 2 and 3 for example, the operator manually opens the suction pump hose valve 100, the pump outlet valve 106, and the spray nozzle hose valve 124. If the first supply hose valve 91, the second supply hose valve 92, and the third supply hose valve 93 are manual valves, then the operator would also open them. The operator also ensures that the hose manifold valve 156 and the auxiliary drain surge valve 152 are closed. The primary drain surge solenoid valve 136, the drain conduit access valve 196, the recirculation return solenoid valve 112, the recirculation tank access valve 90, the chemical solenoid valve 70, the warm water solenoid valve 56, and the tap water solenoid valve 38 are under the control of the controller 160 and are closed. Controller 160 opens lock-out valve 149. If the first supply hose valve 91, the second supply hose valve 92, and the third supply hose valve 93 are electric solenoid valves, then controller 160 would also open them. Addressing the control panel 162 shown in FIG. 9, the operator adjusts the FLUSHING CYCLE CONTROL switch to the START position. The flushing module 22 then automatically monitors itself as it performs in succession the following flushing, cleaning, and rinsing cycles.

Since solids are more difficult to clean and disinfect, it is desirable to dislodge or remove them. It is also desirable to wet the soiled internal surfaces of the patient support device. In accordance with the present invention, a predetermined volume of liquid is used to flush preselected ones of the surfaces of the patient support device that are exposed to substances connected with the care, maintenance, and treatment of a patient. Desirably, a turbulent flow of flushing liquid is applied over preselected ones of the surfaces of the patient support device exposed to substances associated with the care, maintenance, and/or treatment of a patient. In accordance with the present invention, a predetermined volume of flushing liquid is prepared. In order to prepare this predetermined volume of flushing liquid, the controller 160 is preprogrammed to open the tap water solenoid valve 38 to introduce tap water into recirculation tank 24. The level of liquid in the recirculation tank is sensed by a high level liquid sensor 58 that is configured and disposed with respect to the recirculation tank 24 to detect when the tank is filled to a predetermined level corresponding to a predetermined volume of liquid inside the recirculation tank. Desirably, the predetermined volume of liquid inside the recirculation tank is 15 gallons. When the high level liquid sensor 58, which desirably is set to detect when the tank is filled to the 15 gallon level, is activated, the controller 160 receives a signal from the high level liquid sensor 58. The controller is programmed to close the tap water solenoid valve 38 in response to this signal. At this point in the sequence, the recirculation tank is filled with a volume of approximately 15 gallons of tap water. In one embodiment, the highest level of the tap water inside the filled recirculation tank is only a few inches above the sleep surface of the bed 20 being cleansed. However, a head of liquid is produced so that some water may leak into the bed. In an alternative embodiment, the level of liquid in the filled tank 24 is significantly higher than the height of the sleep surface of the bed and thereby provides an additional head to assist priming the recirculation pump 76 with liquid. In this alternative embodiment, an additional valve such as shown at 194 in FIG. 2A would need to be closed by the controller while the recirculation tank was being filled and opened by the controller in conjunction with the operation of the recirculation pump 76.

When the controller 160 receives the electrical signal from the high level liquid sensor 58 located at the 15 gallon level, the controller is preprogrammed to open the primary drain surge solenoid valve 136 and the drain conduit access valve 196, which enable the discharge of the recirculation pump to flow to the drain surge tank 142. The controller also turn on the recirculation pump 76. In a single pass, the 15 gallons of water from the recirculation tank drains from the tank 24, is sucked through the internal conduits of the bed 20, and is pumped to the sewer.

Liquid is pulled through the conduits of the bed by means of the suction of the recirculation pump 76 attached to the suction pump hose 102. In this way, the liquid is pulled across each of the surfaces that has come into contact with substances associated with one or more of the care, maintenance and treatment of a patient. The recirculation pump 76 creates a slight vacuum that draws in liquids through the first, second and third supply hoses 84, 85, 86. Using a pump's suction to create a vacuum to pull liquid through the bed rather than forcing the liquid through the bed under pressure, prevents liquid leaks that could contaminate the bed and that could be difficult to detect and clean. Any leaks that may occur will be air leaks into the flushing module 22 of the present invention.

As the water is drained and sucked out of the recirculation tank 24, the level of liquid inside the recirculation tank falls until the level of liquid drops below the lower level liquid sensor 59. When that occurs, the lower level liquid sensor sends a signal to the controller 160. When the controller receives this signal indicating that the level of liquid inside the recirculation tank has dropped to a predetermined low level inside the tank 24, the controller 160 begins a timed interval that allows the recirculation pump 76 to continue running for a fixed time interval that is designed to ensure that all the liquid is pumped out of the tank 24 without allowing the pump 76 to run for so long that it runs dry and is damaged. At the end of this predetermined time interval, the controller turns off the recirculation pump 76 and closes the primary drain surge tank solenoid valve 136. By pumping all of the liquid out of the tank 24, cross-contamination between consecutive cycles of the process is at least minimized if not avoided altogether.

In accordance with the present invention, a predetermined volume of chemical solution is used to clean and/or disinfect preselected ones of the surfaces of the patient support device that are exposed to substances associated with the care, maintenance, and treatment of a patient. Desirably, a turbulent flow of a chemical solution is circulated for a preselected period of time over preselected ones of said surfaces of the patient support device. In accordance with the present invention, a predetermined volume of chemical solution is prepared. The step of preparing the chemical solution involves filling the recirculation tank 24 with temperature-controlled warm water produced via the temperature mixing valve 42. This manually adjustable valve 42 allows the operator to produce warm water at the outlet of the mixing valve that has a temperature within the range of from about 120° F. to about 160° F. Desirably, a nominal outlet temperature of 140° F. is manually set on the temperature mixing valve 42 for operating the next step of the process. When the controller has turned off the recirculation pump 76 and closed the primary drain surge tank solenoid valve 136 and the drain conduit access valve 196, the controller can be preprogrammed to then open the warm water solenoid valve 56 and the chemical solenoid valve 70 and to operate the chemical metering pump 64 to simultaneously introduce a volumetrically controlled amount of warm water and a volumetrically controlled amount of detergent/disinfectant solution concentrate into the recirculation tank 24. In this way, warm water from the warm water conduit 48 is introduced into the recirculation tank via the warm water branch pipe 52 and the warm water recirculation tank inlet port 54 at the same time as a volumetrically controlled amount of detergent/disinfectant solution concentrate is introduced into the recirculation tank. By simultaneously adding the warm water and the detergent/disinfectant into the recirculation tank, the detergent/disinfectant and warm water are thoroughly mixed. The recirculation tank fills with warm water until the level reaches the high level liquid sensor 58, which in this example corresponds to a volume of approximately 15 gallons of the warm water.

When the high level liquid sensor 58 detects warm water in the recirculation tank 24, it signals the controller 160. When the controller receives this signal from the high level sensor 58, the controller can be preprogrammed to close the warm water solenoid valve 56 and to turn off the chemical metering pump 64. In addition, the controller can be preprogrammed to configure the solenoid valves to recirculate the detergent/disinfectant solution and supply the detergent/disinfectant solution under pressure to the spray tree wands 118 and to the spray nozzle 133. The controller can be preprogrammed to effect this plumbing configuration by opening the recirculation return solenoid valve 112 and the recirculation tank access valve 90. Thus, during the recirculation step of the process the following valves are open: the recirculation return solenoid valve 112, the recirculation tank access valve 90, the first hose valve 91, the second hose valve 92, the third hose valve 93, the spray nozzle hose valve 124, the suction pump hose valve 100, and the pump outlet valve 106. During the recirculation step of the process the following valves are closed: the chemical solenoid valve 70, the warm water solenoid valve 56, the tap water solenoid valve 38, the hose manifold valve 156, the primary drain surge tank solenoid valve 136, the drain conduit access valve 196, the auxiliary drain surge tank valve 152, and the lock-out valve 149.

When the controller opens the recirculation return solenoid valve 112 and the recirculation tank access valve 90, the controller desirably is preprogrammed so that it also turns on the recirculation pump 76, and warm detergent/disinfectant solution is circulated through the patient support device's internal lines for a predetermined time (approximately 15 minutes) according to the programming of the controller 160. The 15 gallons of warm detergent/disinfectant solution from the recirculation tank drains from the tank 24 into the bed 20, is sucked through the internal conduits of the bed 20 and is pumped back into the recirculation tank via the recirculation return solenoid valve 112, the recirculation pipe 110, the recirculation tank supply pipe 116, and the recirculation tank access valve 90. The cleansing/disinfecting liquid is vigorously sprayed inside the separator tank 130 and inside the jugs 120 placed on the spray tree wands 118, to cleanse and disinfect the internal surfaces of the separator tank 130 and the jugs 120 at the same time that the other internal surfaces of the bed are being cleansed and disinfected. More specifically, and referring to FIGS. 2 and 3, after pressurization by recirculation pump 76, the liquid leaves the outlet of recirculation pump 76 and passes through pump outlet pipe 104 and pump outlet valve 106. Since primary drain surge tank solenoid valve 136 is closed, the liquid continues under pressure through recirculation return solenoid valve 112 and recirculation return pipe 110. Since recirculation tank access valve 90 is opened, the liquid continues under pressure through recirculation tank supply pipe 116 and into spray tree pipe manifold 115 and spray tree wands 118 inside recirculation tank 24. If any containers 120 are disposed on wands 118, the liquid is forced under pressure to cleanse the inside of these containers 120. The liquid also enters recirculation tank 24 via rinse ring pipe 111 and rinse ring 108 as shown in FIG. 4. The recirculation solution contained in recirculation tank 24 exits recirculation tank 24 via drain pipe 78 and continues into hose manifold 80. Since hose manifold valve 156 is closed, the liquid continues to be sucked into each of first hose pipe 81, second hose pipe 82, and third hose pipe 83 and thence through each of first, second, and third hose valves, 91, 92 and 93, respectively. The liquid then flows under a small vacuum through each of first, second, and third supply hoses, 84, 85, and 86, respectively, and into the bed being cleaned. In a CLENSICAIR ® bed for example, this liquid eventually finds its way under a small vacuum via conduits 176 and 178 (FIG. 10) into separator 130. Since spray nozzle hose valve 124 is open and drain conduit access valve 196 is closed, the recirculating liquid also finds its way under pressure through spray nozzle hose 122 and into separator 130 (FIG. 7) via curved conduit 132 and nozzle 133. As shown in FIG. 7 for example, this liquid under pressure supplied to separator 130, is sucked out of separator 130 via first fluid passage 127 of concentric Y-fitting 126 and flows through suction pump hose 102 via open suction pump hose valve 100 to suction pump pipe 98 and into the suction side (i.e., inlet) of recirculation pump 76.

In employing the embodiment of the liquid supplying and removing means shown schematically in FIG. 2A to supply liquid under an augmented pressure head during the recirculation cycle to the bed being cleaned, the following valves must be open to allow flow therethrough: pump outlet valve 106; recirculation return solenoid valve 112; first pressure path valve 191; each of first, second, and third hose valves 91, 92, and 93, respectively; spray nozzle hose valve 124; suction pump hose valve 100; second pressure path valve 192; and third pressure path valve 193. In employing the embodiment of the liquid supplying and removing means shown schematically in FIG. 2A to supply liquid under an augmented pressure head during the recirculation cycle to the bed being cleaned, the following valves desirably are closed to prevent flow therethrough: hose manifold valve 156; fourth and fifth pressure path valves 194, 195, respectively; recirculation tank access valve 90; drain conduit access valve 196; primary drain surge tank solenoid valve 136; and auxiliary drain surge tank valve 152.

Still referring to FIG. 2A, after pressurization by recirculation pump 76, the liquid leaves the outlet of recirculation pump 76 and passes through pump outlet pipe 104 and pump outlet valve 106. Since primary drain surge tank solenoid valve 136 is closed, the liquid continues under pressure through recirculation return solenoid valve 112 and recirculation return pipe 110. Since recirculation tank access valve 90 is closed, the liquid continues under pressure through recirculation tank supply pipe 116 and into first pressure path pipe 181. Since first pressure path valve 191 is open, the liquid continues under pressure through first pressure path valve 191 and into hose manifold 80. The liquid continues to flow under pressure through each of first hose pipe 81, second hose pipe 82, and third hose pipe 83 and thence through each of first, second, and third hose valves, 91, 92 and 93, respectively. The liquid then flows under pressure through each of first, second, and third supply hoses, 84, 85, and 86, respectively, and into the bed being cleaned. In a CLENSICAIR ® bed for example, this liquid eventually finds its way under pressure via conduits 176 and 178 (FIG. 10) into separator 130. Since spray nozzle hose valve 124 is open and primary drain surge tank solenoid valve 136, auxiliary drain surge tank valve 152 and drain conduit access valve 196 are closed, the recirculating liquid also finds its way under pressure through spray nozzle hose 122 and into separator 130 (FIG. 7) via curved conduit 132 and nozzle 133.

In order to use this FIG. 2A embodiment of the supplying and removing means to provide liquid under an augmented pressure head into the various conduits and containers of the bed being cleaned, containers such as the separator 130 of the CLENSICAIR ® bed must be constructed with sufficient integrity to withstand the pressures of the liquid supplied by the supplying and removing means. As shown in FIG. 7 for example, this liquid under pressure supplied to separator 130, exits separator 130 via first fluid passage 127 of concentric Y-fitting 126 and flows through suction pump hose 102 via open suction pump hose valve 100. Since both fifth pressure path valve 195 and hose manifold valve 156 are closed, the liquid continues along its path through second pressure path pipe 182 and through open second pressure path valve 192 into a branch of recirculation tank supply pipe 116. Since recirculation tank access valve 90 is closed, the liquid continues into recirculation tank 24 and through spray tree wands 118 and nozzles 114 inside recirculation tank 24. If any containers 120 are disposed on wands 118, the liquid is forced under pressure to cleanse the inside of these containers 120. The liquid also enters recirculation tank 24 via rinse ring pipe 111 and rinse ring 108 as shown in FIG. 4. The recirculation solution contained in recirculation tank 24 exits recirculation tank 24 via drain pipe 78. Since fourth and fifth pressure path valves 194, 195 are closed and third pressure path valve 193 is open, the liquid is sucked from drain pipe 78 through third pressure path pipe 183 to suction pump pipe 98 and enters the suction side or inlet of recirculation pump 76.

Alternatively, in employing the embodiment of the liquid supplying and removing means shown schematically in FIG. 2A to supply liquid during the recirculation cycle to the bed being cleaned, but without an augmented pressure head, the following valves must be open to allow flow therethrough: pump outlet valve 106; recirculation return solenoid valve 112; each of fourth and fifth pressure path valves 194, 195, respectively; recirculation tank access valve 90; each of first, second, and third hose valves 91, 92, and 93, respectively; spray nozzle hose valve 124; and suction pump hose valve 100. In employing the embodiment of the liquid supplying and removing means shown schematically in FIG. 2A to supply liquid during the recirculation cycle to the bed being cleaned, but without an augmented pressure head, the following valves must be closed to prevent flow therethrough: hose manifold valve 156; first, second, and third pressure path valves 191, 192, and 193, respectively; drain conduit access valve 196; primary drain surge tank solenoid valve 136; and auxiliary drain surge tank valve 152. Referring again to FIG. 2A, after pressurization by recirculation pump 76, the liquid leaves the outlet of recirculation pump 76 and passes through pump outlet pipe 104 and pump outlet valve 106. Since primary drain surge tank solenoid valve 136 is closed, the liquid is constrained to flow under pressure through recirculation return solenoid valve 112 and recirculation return pipe 110. Since recirculation tank access valve 90 is opened, the liquid continues under pressure through recirculation tank supply pipe 116 and through rinse ring pipe 111 into recirculation tank 24 and through spray tree pipe manifold 115, spray tree wands 118 and nozzles 114 inside recirculation tank 24. If any containers 120 are disposed on wands 118, the liquid is forced under pressure to cleanse the inside of these containers 120. The liquid also enters recirculation tank 24 via rinse ring pipe 111 and rinse ring 108 as shown in FIG. 4. The recirculation solution contained in recirculation tank 24 exits recirculation tank 24 via drain pipe 78. Since fourth pressure path valve 194 is opened and hose manifold valve 156 and third pressure path valve 193 are closed, the liquid continues along its path through drain pipe 78 and into hose manifold 80. The liquid continues to flow through each of first hose pipe 81, second hose pipe 82, and third hose pipe 83 and thence through each of first, second, and third hose valves, 91, 92 and 93, respectively. The liquid then flows through each of first, second, and third supply hoses, 84, 85, and 86, respectively, and into the bed being cleaned. In a CLENSICAIR® bed for example, this liquid eventually finds its way under pressure via conduits 176 and 178 (FIG. 10) into separator 130. Since spray nozzle hose valve 124 is open and first pressure path valve 191, primary drain surge tank solenoid valve 136, auxiliary drain surge tank valve 152, and drain conduit access valve 196 are closed, the recirculating liquid also finds its way under pressure through spray nozzle hose 122 and into separator 130 (FIG. 7) via curved conduit 132 and nozzle 133. As shown in FIG. 7 for example, this liquid under pressure supplied to separator 130, exits separator 130 via first fluid passage 127 of concentric Y-fitting 126 and flows through suction pump hose 102 via open suction pump hose valve 100. Since fifth pressure path valve 195 is open and hose manifold valve 156 and second and third pressure path valves 192, 193, respectively, are closed, the liquid travels through suction pump pipe 98 and enters the suction side (i.e., inlet) of recirculation pump 76.

Moreover, provided that electrically actuated solenoid valves are used for each of recirculation tank access valve 90, drain conduit access valve 196, and the first through fifth pressure path valves 191, 192, 193, 194, and 195, controller 160 can be programmed to alternate the FIG. 2A embodiment of the supplying and removing means from the configuration that allows the additional pressure head to propel the liquid through the first, second and third supply hoses 84, 85, and 86, respectively, and the configuration that only allows the relatively reduced pressure head to propel the liquid through the first, second and third supply hoses 84, 85, and 86, respectively. In this way, less strain will be placed on the conduits of the bed than if the relatively increased pressure head were to be employed continuously during the recirculation step, yet more vigorous cleansing of the bed's conduits will occur than if the relatively reduced pressure head were to be employed continuously during the recirculation step.

At the end of the recirculation cycle time, the controller desirably is preprogrammed to reconfigure the module's valves to drain the cleansing/disinfecting liquid from the recirculation tank and the patient support device. Specifically, the controller 160 is programmed to close the recirculation return solenoid valve 112 and the recirculation tank access valve 90, and open the primary drain surge tank solenoid valve 136, the drain conduit access valve 196, and the lock-out valve 149. The controller is desirably programmed to continue operating the recirculation pump 76, and the discharge of the recirculation pump is directed to the drain surge tank 142.

As the cleansing/disinfecting liquid is drained and sucked out of the recirculation tank 24 and the patient support device 20, the level of liquid inside the recirculation tank falls until the level of liquid drops below the lower level liquid sensor 59 of the recirculation tank. When that occurs, the lower level sensor sends a signal to the controller. When the controller receives this signal indicating that the level of liquid inside the recirculation tank has dropped to a predetermined low level inside the tank, the controller desirably is programmed to begin a timed interval that allows the recirculation pump to continue running for a fixed time interval that is designed to ensure that all the liquid is pumped out of the tank and the patient support device without allowing the pump to run for so long that it runs dry and is damaged. At the end of this fixed time interval, the controller desirably is programmed to turn off the recirculation pump and close the primary drain surge tank solenoid valve 136 and the drain conduit access valve 196. By pumping substantially all of the liquid out of the tank 24, cross-contamination between consecutive cycles of the process is at least minimized if not avoided altogether.

After the detergent/disinfectant solution has been drained from the patient support device and the recirculation tank, some detergent residues may be present. In accordance with the present invention, a rinsing step can be performed. A predetermined volume of liquid can be used to rinse preselected ones of the surfaces of the patient support device that have been exposed to the chemical solution in the immediately preceding cycle of the method of the present invention. Desirably, a turbulent flow of rinsing liquid is applied over these internal surfaces of the patient support device. In accordance with the present invention, a predetermined volume of rinsing liquid is prepared. In order to prepare this predetermined volume of rinsing liquid, the controller performs in the same way as the first flushing step described above. Accordingly, the rinsing step requires a new volume of approximately 15 gallons of tap water to be introduced into the recirculation tank using the high level liquid sensor 58. The controller reconfigures the solenoid valves to fill the recirculation tank with tap water by opening the tap water solenoid valve 38 until the high level liquid sensor 58 signals that the desired volume of tap water is present. The controller then closes the tap water solenoid valve 38, opens the primary drain surge tank solenoid valve 136 and the drain conduit access valve 196, and turns on the recirculation pump 76. This rinsing liquid is then passed through the patient support device in a single pass, in order to rinse it and remove any detergent residues. Finally, the controller again performs the timed pump drainage sequence to pump all of the rinsing liquid out of the recirculation tank to minimize or eliminate cross-contamination between consecutive steps of the process.

Normally, at the end of each of the flushing, cleansing/disinfecting, and rinsing cycle, the controller continues operating the recirculation pump until all of the flushing, cleansing/disinfecting or rinsing liquid, respectively, is drained out of the recirculation tank. The normal desired operating sequence consisting of a flushing cycle, followed by a cleaning/disinfecting cycle, followed by a rinsing cycle, is now complete. The operator disconnects the hoses from the bed and performs other operations.

The controller provides the flexibility to change the operating sequence of the flushing module by changing the programming of the microprocessor accordingly. For example, the final rinsing cycle can be performed with warm water if desired instead of tap water. In another example, the controller can be preprogrammed to perform a soaking step such as the following sequence of operating instructions. At a preprogrammed moment during the cleansing step described above, the controller can be programmed to stop the operation of recirculation pump 76 for a predetermined period of time to allow the warm water cleaning/disinfecting solution to stop flowing through the bed. This soaking would allow the thermal, chemical and wetting actions of the solution to soften the materials that were deposited on the internal surfaces of the conduits and internal chambers and containers of the bed. The cleaning/disinfecting solution would be able to contact areas where air leaks or venturi effects in the hoses, conduits and other bed components during the turbulent flow of the cleaning cycle, tend to limit contact with the cleaning-/disinfecting solution.

In yet another example, the controller can be preprogrammed to perform one or more steps in which the flow through one or more of the supply hoses 84, 85, 86, is sequenced in some order. Since recirculation pump 76 is desirably a progressive cavity pump, which operates on the displacement principle, the flow is distributed about the open lines, in this case supply hoses 84, 85, 86. To increase flow through one hose, the flow through one or more of the other hoses must be decreased. As long as the hose valves 91, 92, 93 are electrically actuated solenoid valves, at a preprogrammed moment during one or more of the flushing step, the cleansing step and the rinsing step described above, the controller can be programmed to close one or more of the hose valves 91, 92, 93 so that the flow through the remaining hose valves increases. In this way, the sequencing step would allow higher temporary flow rates in selected hoses 84, 85, 86, without having to increase the size (and electrical power requirements) of the recirculation pump 76. Moreover, each selected sequencing step also produces a selected and alternating soaking step because each supply hose that is deprived of flow would be permitting the bed conduits that are normally supplied by that hose to be soaked by the static liquid contained therein during the timed interval of flow deprivation. Then once flow was restored by opening the corresponding solenoid hose valve 91, 92, or 93, the flow could be increased in the previously static hose and connected soaking bed conduits, by closing one or more of the other hose solenoid valves 91, 92, or 93.

In still further accordance with the present invention, the controller can be programmed to include a power-interruption mode. If power to the flushing module 22 is interrupted during operation of the flushing module, the controller is preprogrammed to alert the operator that the power has been lost and restored. As shown in FIG. 9, a flashing light disposed beneath the "EMERGENCY STOP" heading on the control panel 162 indicates to the operator that the power has been lost and restored. The controller is preprogrammed to remember where it was in the operating sequence when power was interrupted. As shown in FIG. 9, a pattern of flashing lights disposed beneath the "SEQUENCE" heading on the control panel 162 indicates to the operator where flushing module 22 was in its operating sequence when power was interrupted. Then, when power is restored, the controller is capable of resuming the sequence of operations. However, the microprocessor is not programmed to automatically resume the operating sequence, because there could be an unsafe condition that has occurred during the interval of time when power was interrupted. Instead, the microprocessor desirably is programmed so that the operating sequence is not resumed until the operator resets the flushing module by moving the FLUSHING CYCLE CONTROL switch on the control panel (FIG. 9) into the PAUSE position and then back to the START position. If a very long power shutdown has occurred, the recommended procedure would be to repeat the entire cycle by turning the FLUSHING CYCLE CONTROL switch to the STOP position and then to the START position, which resets the cycle to the beginning.

The microprocessor also can be programmed to provide the flexibility to monitor the operating sequence of the flushing module and the status of the bed and change the operating sequence of the flushing module accordingly. In further accordance with the present invention, a means can be provided for communication between the flushing module and the bed to be cleaned. As embodied herein and shown in FIGS. 2A and 3 for example, controller 160 can be connected to the bed by a cable 166 having a connector 168 configured to be connected to a mating connector on the bed to be cleaned. The form of communication between flushing module 22 and the bed could be either serial data communications such as via an RS-232 data communication port, or it could be by an analog signal. Such communication between the flushing module and the bed also could be in the form of a simple digital status contact such as a relay or a transistor output. By one of these means, controller 160 can be programmed to send a signal to the bed to position certain of the bed's valves or other components into a configuration that was desired for one or more of the cycles of the flushing module. The bed would need to be configured with the capability to respond to these signals, but this easily could be accomplished in any bed having its own controller or having a receptive electrical circuit to receive the signals from controller 160 of module 22. When cleaning the CLENSICAIR® bed for example, it is desirable to cycle the position of the internal flow diverter valve during the cleaning cycle so that the inside of the valve is thoroughly cleaned and to ensure that both the basin hose and the wand hose 178 (FIG. 1) receive a full flow of cleaning liquid during at least parts of the cleaning cycle. Controller 160 of module 22 could be programmed to initiate this cycling of the bed's flow diverter valve at the desired time during the cleaning cycle.

Controller 160 also could be programmed to recognize the specific model of the bed and select a predetermined cleaning cycle that is specifically tailored to that particular model of bed. Controller 160 also can be programmed to receive monitoring information from the bed's controller, which may have the capability to monitor pressure and temperature at certain internal locations in the bed. The bed's controller also may monitor the positions or states of certain valves, flow controls and other components. Controller 160 can be preprogrammed to receive this information from the bed's controller so that this pressure information, temperature information, and component status information could be used by controller 160 to make adjustments to the cleaning process being performed on the bed. For example, if the temperature at a certain point in the bed dropped below a predetermined temperature, controller 160 can be programmed to adjust an auxiliary electric heater 41 (FIGS. 2 and 3) to increase the temperature of the liquid exiting recirculation tank 24 via drain pipe 78. In this way, heat can be added to the circulating liquid without increasing the volume of liquid, as would occur if hot water were added from the hot water conduit 40 or if warm water were added via mixing valve 42.

With the aid of a flushing module, a service technician can clean and disinfect a CLENSICAIR® bed in approximately 45 minutes. This assumes that the controller is programmed so that the automated flushing module performs a process consisting of three consecutive cycles, an initial 10-minute flushing cycle, a 15-minute cleansing and disinfection cycle, and a final 5-minute rinse cycle. While the flushing module is undergoing the consecutive cycles of flushing, cleaning and rinsing the bed's internals, technicians may conduct other cleaning operations such as wiping down the frame and bed surfaces with disinfecting solutions, removing cushions for laundering, cleaning the external components, and so forth, or these operations may be done at another time. Since certain operations can be conducted simultaneously, a facility with a single flushing module 22 can clean and disinfect 6 to 8 CLENSICAIR® beds each day.

A facility responsible for a large population of beds may need more than one flushing module to keep up with the demand for cleaning the beds. In accordance with the present invention, each flushing module 22 has been designed to be adaptable to operate in a multiple module configuration. As shown in Fig, 11, a multiple module configuration may be provided and include several modules 22 disposed adjacent one another in a single facility. A preferred embodiment of the multiple module configuration includes a primary module disposed between two secondary modules, a left-hand module and a right-hand module. Each module 22 has been designed to be ambidextrous in the sense that it can be employed in a configuration with an additional module 22 either to the left or to the right. Each module has a pipe header across the rear so that drain conduits 140 can be connected to run to a single sewer line and the modules can share the facility's supply of tap water and hot water via each module's respective tap water conduit 32 and hot water conduit 40. In order to minimize duplication of key components in the multiple module configuration, the primary module desirably is provided with certain components that are shared with the secondary modules rather than being duplicated in the secondary modules. Power from the facility is connected to the primary module and thence to the secondary modules. Only the primary module includes a mixing valve 42, which provides warm water via warm water conduits 48 to all of the modules in the configuration. Only the primary module includes a chemical metering pump 64, which distributes the chemical solution, such as detergent/disinfectant liquid concentrate, via chemical conduits 60 to all of the modules in the configuration. The primary module's controller includes a microprocessor that is designed so that it can simultaneously control its own operation and that of the secondary modules. Moreover, a different program is not needed to run multiple modules with the same microprocessor. The primary module has a microprocessor with spare rack space that allows additional cards to be plugged in to expand it to serve additional input and output positions. The controllers of the secondary modules can plug into the controller of the primary module via cables. Thus, the control panels of the secondary modules may look identical to the control panel on the primary module but need not have the same electronics inside.

What is claimed is:

1. An apparatus for cleansing a device including a patient support surface and having one or more of components including internal hoses, valves, tanks, conduits, fittings, receptacles, containers, having internal surfaces that become exposed to contact with substances associated with the care, maintenance, or treatment of a patient, at least one of the components being removable from the device in the course of ordinary usage of the device, the apparatus comprising:

a flushing module configured to cleanse at least one of the device's components having such internal surfaces without disassembling the at least one component from the device, said flushing module including:

a means for preparing a liquid to be supplied to at least one of the device's internal surfaces exposed to substances associated with the care, maintenance, or treatment of a patient;

a means for supplying said liquid to at least one of the device's internal surfaces exposed to substances associated with the care, maintenance, or treatment of a patient and for removing said liquid supplied to at least one of the device's internal surfaces exposed to substances associated with the care, maintenance, or treatment of a patient without having to disassemble the at least one component from the device; and a means for disposing of said liquid removed from at least one of the device's internal surfaces exposed to substances associated with the care, maintenance, or treatment of a patient.

2. An apparatus as in claim 1, wherein said liquid preparing means includes a recirculation tank.

3. An apparatus as in claim 2, further comprising a means for monitoring the level of liquid inside said recirculation tank.

4. An apparatus as in claim 2, wherein said liquid supplying and removing means includes a means for returning liquid to said recirculation tank.

5. An apparatus as in claim 2, further comprising:

a lid hingedly attached to cover at least a portion of the top of said recirculation tank, said lid being configured and disposed at a slight angle below the horizontal when disposed to cover said recirculation tank.

6. An apparatus as in claim 1, wherein said liquid preparing means includes a temperature mixing valve.

7. An apparatus as in claim 1, wherein said liquid preparing means includes a chemical metering pump configured to introduce a volumetrically controlled amount of chemical.

8. An apparatus as in claim 1, wherein said liquid supplying and removing means includes a recirculation pump selectively connectable in communication with said liquid preparing means.

9. An apparatus as in claim 1, wherein said liquid supplying and removing means includes:

a recirculation pump having an outlet;

a spray nozzle hose selectively connectable in communication with said outlet of said pump; and a spray nozzle hose valve configured and disposed to regulate the flow of liquid between said spray nozzle hose and said outlet of said pump.

10. An apparatus as in claim 1, wherein said liquid supplying and removing means includes at least one liquid supply hose selectively connectable in communication with said liquid preparing means and with at least one of the internal conduits of the device without disassembly of the at least one internal conduit of the devices.

11. An apparatus as in claim 10, further comprising a means for monitoring the liquid flow rate supplied to said at least one liquid supply hose.

12. An apparatus as in claim 10, further comprising a means for alerting the operator when flow through said at least one liquid supply hose becomes less than a predetermined amount of flow.

13. An apparatus as in claim 1, wherein said liquid supplying and removing means includes at least one Y-fitting selectively connectable in communication with said liquid preparing means and with at least one of the internal conduits of the device.

14. An apparatus as in claim 1, wherein said liquid disposing means includes a drain surge tank.

15. An apparatus as in claim 14, further comprising a means for monitoring the level of liquid inside said drain surge tank.

16. An apparatus as in claim 14, wherein said liquid disposing means includes a drain surge tank solenoid valve configured and disposed to control the flow of liquid entering said drain surge tank.

17. An apparatus as in claim 1, further comprising:

a means for automatically controlling the operation of at least said liquid supplying means, said liquid removing means, and said liquid disposing means in a predetermined sequence of operations.

18. An apparatus as in claim 17, wherein said automatic controlling means includes a microprocessor and a control panel connected in electrical communication with said microprocessor.

19. An apparatus as in claim 1, further comprising:

a means for cleansing the internal surfaces of at least one of the removable containers of the device.

20. An apparatus as in claim 19, wherein said means for cleansing the internal surfaces of at least one of the removable containers of the device includes at least one spray tree wand configured and disposed to receive at least one of the removable containers of the device and connected in communication with said liquid supplying and removing means.

21. An apparatus as in claim 1, further comprising:

a means for cleansing the internal surfaces of at least one of the containers of the device without having to disassemble the at least one container from the device.

22. An apparatus as in claim 21, wherein said means for cleansing the internal surfaces of at least one of the containers of the device includes a spray nozzle configured to be disposed inside at least one of the containers of the device and connected in communication with said liquid supplying and removing means.

23. An apparatus as in claim 1, further comprising:

a rigid frame configured and disposed to carry said liquid preparing means and said liquid supplying and removing means.

24. An apparatus as in claim 23, further comprising:

a supplemental containment basin configured and disposed to carry said rigid frame.

25. An apparatus as in claim 23, further comprising:

a means for mobilizing said rigid frame.

26. An apparatus for cleansing a device for the care, maintenance, and treatment of a patient, the device having hoses, a basin, a rinse dispensing wand, a waste pump system, a separator tank, valves, a waste holding jug, a rinse solution jug, conduits, and fittings, the apparatus comprising:

a frame;

a tap water conduit configured to be selectively connectable in communication with a supply of tap water;

a hot water conduit configured to be selectively connectable in communication with a supply of hot water;

a mixing valve having a first inlet connected in communication with said tap water conduit, having a second inlet connected in communication with said hot water conduit, and having an outlet configured to be connected in communication with a warm water conduit;

a warm water conduit connected in communication with said outlet of said mixing valve;

a chemical conduit configured to be selectively connectable in communication with a supply of a chemical solution containing detergent and/or disinfectant;

a chemical reservoir configured for containing a chemical solution including detergent and/or disinfectant;

a chemical metering pump having an inlet connected in communication with said chemical reservoir and having an outlet connected in communication with said chemical conduit;

a recirculation pump having a positive pressure outlet and a negative pressure inlet;

a pump outlet valve configured and disposed to regulate the flow of liquid from said outlet of said recirculation pump;

a recirculation tank carried by said frame and having an outlet, a chemical inlet port, a tap water inlet port, and a warm water inlet port;

a chemical solenoid valve disposed to regulate communication between said chemical conduit and said chemical inlet port of said recirculation tank to regulate the flow of chemical from said chemical conduit to said chemical inlet port of said recirculation tank;

a warm water solenoid valve disposed to regulate communication between said warm water conduit and said warm water inlet port of said recirculation tank to regulate the flow of warm water from said warm water conduit to said warm water inlet port of said recirculation tank;

a tap water solenoid valve disposed to regulate communication between said tap water conduit and said tap water inlet port of said recirculation tank to regulate the flow of tap water from said tap water conduit to said tap water inlet port of said recirculation tank;

a recirculation tank liquid level sensor configured and disposed to detect the level of liquid inside said recirculation tank;

a spray tree manifold disposed in said recirculation tank and having an inlet and at least one spray wand with at least one nozzle;

a recirculation solenoid valve configured and disposed to regulate the flow of liquid between said spray tree manifold and said outlet of said recirculation pump;

a hose manifold selectively connectable in communication with said outlet of said recirculation tank;

a hose manifold valve configured and disposed to regulate the flow of liquid between said inlet of said recirculation pump and said hose manifold;

a first supply hose selectively connectable in communication with said hose manifold;

a first hose valve configured and disposed to regulate the flow of liquid between said first supply hose and said hose manifold;

a first hose flow rate sensor configured and disposed to sense the rate of flow of liquid between said first supply hose and said hose manifold;

a second supply hose selectively connectable in communication with said hose manifold;

a second hose valve configured and disposed to regulate the flow of liquid between said second supply hose and said hose manifold;

a second hose flow rate sensor configured and disposed to sense the rate of flow of liquid between said second supply hose and said hose manifold;

a third supply hose selectively connectable in communication with said hose manifold;

a third hose valve configured and disposed to regulate the flow of liquid between said third supply hose and said hose manifold;

a third hose flow rate sensor configured and disposed to sense the rate of flow of liquid between said third supply hose and said hose manifold;

a suction pump hose selectively connectable in communication with said inlet of said recirculation pump;

a suction pump hose valve configured and disposed to regulate the flow of liquid between said suction pump hose and said inlet of said recirculation pump;

a spray nozzle hose selectively connectable in communication with said outlet of said recirculation pump;

a spray nozzle hose valve configured and disposed to regulate the flow of liquid between said spray nozzle hose and said outlet of said recirculation pump;

a concentric Y-fitting configured with a first liquid passage and a second liquid passage disposed concentrically with respect to said first liquid passage, one of said suction pump hose and said spray nozzle hose being selectively connectable in communication with said first liquid passage and the other of said suction pump hose and said spray nozzle hose being selectively connectable in communication with said second liquid passage;

a drain surge tank having an inlet and an outlet, said outlet of said drain surge tank being configured to be connected in communication with a sewer line;

a drain conduit configured to be connected in communication with said inlet of said drain surge tank;

a primary drain surge tank valve configured and disposed to regulate the flow of liquid between said outlet of said recirculation pump and said inlet of said drain surge tank;

a check valve configured and disposed to prevent the flow of liquid from said drain surge tank to said outlet of said recirculation pump;

a flow strainer configured and disposed to strain the flow of liquid from said outlet of said recirculation pump to said drain surge tank;

an auxiliary drain surge tank valve configured and disposed to bypass said flow strainer and to regulate the flow of liquid between said outlet of said recirculation pump and said drain surge tank;

a drain surge tank high liquid level sensor configured and disposed to detect a high level of liquid inside said drain surge tank; and a programmable controller connected in electrical communication with said recirculation solenoid valve, with said primary drain surge tank solenoid valve, with said tap water solenoid valve, with said warm water solenoid valve, with said chemical solenoid valve, with said chemical metering pump, with said recirculation pump, with said recirculation tank liquid level sensor, with said drain surge tank high liquid level sensor, and with each of said first, second and third hose flow rate sensors.

* * * * *